US011359355B2

(12) United States Patent
Cheyne et al.

(10) Patent No.: US 11,359,355 B2
(45) **Date of Patent: *Jun. 14, 2022**

(54) WEAR ASSEMBLY

(71) Applicant: ESCO Group LLC, Portland, OR (US)

(72) Inventors: Mark A. Cheyne, Portland, OR (US); Noah D. Cowgill, Milwaukie, OR (US); Michael B. Roska, Portland, OR (US); Donald M. Conklin, Lake Oswego, OR (US); Scott H. Zenier, Portland, OR (US); Chris J. Hainley, Portland, OR (US)

(73) Assignee: ESCO GROUP LLC, Portland, OR (US)

( * ) Notice: Subject to any disclaimer, the term of this patent is extended or adjusted under 35 U.S.C. 154(b) by 349 days.

This patent is subject to a terminal disclaimer.

(21) Appl. No.: 15/984,247

(22) Filed: May 18, 2018

(65) Prior Publication Data

US 2018/0266085 A1 Sep. 20, 2018

Related U.S. Application Data

(62) Division of application No. 14/838,117, filed on Aug. 27, 2015, now Pat. No. 10,364,554, which is a (Continued)

(51) Int. Cl.
*E02F 9/28* (2006.01)
*E02F 9/26* (2006.01)

(52) U.S. Cl.
CPC ..... *E02F 9/2883* (2013.01); *E02F 9/267* (2013.01); *E02F 9/2825* (2013.01); (Continued)

(58) Field of Classification Search
CPC ..... E02F 9/2883; E02F 9/267; E02F 9/2825; E02F 9/2833; E02F 9/2841; E02F 9/2858
See application file for complete search history.

(56) References Cited

U.S. PATENT DOCUMENTS 3,444,633 A 5/1969 Hensley
4,433,496 A 2/1984 Jones et al.
(Continued)

FOREIGN PATENT DOCUMENTS

AU 2006206066 6/2010
AU 2012100452 5/2012
(Continued)

OTHER PUBLICATIONS

Declaration of Benjamin David Hughes re AU Patent Application No. 2016253640 opposition by CQMS Pty Ltd., 7 pages, dated Oct. 10, 2018.

(Continued)

*Primary Examiner* — Jamie L McGowan
(74) *Attorney, Agent, or Firm* — Steven Schad; Palmer Dzurella

(57) ABSTRACT

A wear assembly for use on various kinds of earth working equipment that includes a base with a supporting portion, a wear member with a cavity into which the supporting portion is received, and a lock to releasably secure the wear member to the base. The supporting portion is formed with top and bottom recesses that receive complementary projections of the wear member. These recesses and projections include aligned holes so as to receive and position the lock centrally within the wear assembly and remote from the wear surface. The hole in the wear member is defined by a wall that includes a retaining structure provided with an upper bearing surface and a lower bearing surface for contacting and retaining the lock against upward and downward movement in the hole. The lock includes a mounting component that defines a threaded opening for receiving a threaded pin that is used to releasably hold the wear member to the base. The separate mounting component can be easily manufactured and secured within the wear member for less (Continued)

expense and higher quality than forming the threads directly in the wear member.

19 Claims, 21 Drawing Sheets

Related U.S. Application Data division of application No. 13/547,353, filed on Jul. 12, 2012, now Pat. No. 9,222,243.

(60) Provisional application No. 61/507,726, filed on Jul. 14, 2011, provisional application No. 61/576,929, filed on Dec. 16, 2011.

(52) U.S. Cl.
CPC ..... *E02F 9/2833* (2013.01); *E02F 9/2841* (2013.01); *E02F 9/2858* (2013.01)

(56) References Cited

U.S. PATENT DOCUMENTS

| | | | | |
|---|---|---|---|---|
| 4,932,478 | A | 6/1990 | Jones | |
| 5,068,986 | A | 12/1991 | Jones | |
| 5,077,918 | A | 1/1992 | Garman | |
| 5,144,762 | A | 9/1992 | Robinson | |
| 5,337,495 | A | 8/1994 | Pippins | |
| 5,709,043 | A | 1/1998 | Jones et al. | |
| 5,802,752 | A | 9/1998 | Quarfordt | |
| 5,868,518 | A | 2/1999 | Chesterfield et al. | |
| 5,913,605 | A | 6/1999 | Jusselin et al. | |
| 6,145,224 | A | 11/2000 | Stickling | |
| 6,393,739 | B1 | 5/2002 | Shamblin et al. | |
| 6,430,851 | B1 | 8/2002 | Clendenning | |
| 6,708,431 | B2 | 3/2004 | Robinson et al. | |
| 6,959,506 | B2 | 11/2005 | Adamic et al. | |
| 7,036,249 | B2 * | 5/2006 | Mautino ..... | E02F 9/2825 37/455 |
| 7,171,771 | B2 | 2/2007 | Briscoe | |
| 7,178,274 | B2 | 2/2007 | Emrich | |
| 7,578,081 | B2 | 8/2009 | Bearden et al. | |
| 7,640,684 | B2 | 1/2010 | Adamic et al. | |
| D614,476 | S | 4/2010 | Buhse | |
| 7,730,651 | B2 | 6/2010 | Carpenter | |
| 7,762,015 | B2 | 7/2010 | Smith et al. | |
| 7,980,011 | B2 | 7/2011 | Ruvang | |
| 8,024,874 | B2 | 9/2011 | McClanahan et al. | |
| 8,127,476 | B2 | 3/2012 | Bierwith | |
| 8,720,087 | B2 | 5/2014 | Briscoe et al. | |
| 8,844,175 | B2 | 9/2014 | Snyder | |
| 2005/0229442 | A1 | 10/2005 | Jones et al. | |
| 2011/0030247 | A1 * | 2/2011 | Ruvang ..... | E02F 9/2841 37/455 |
| 2013/0180137 | A1 | 7/2013 | Hurley et al. | |

FOREIGN PATENT DOCUMENTS

| | | |
|---|---|---|
| CN | 101821458 | 9/2010 |
| EA | 0022167 | 12/2010 |
| EP | 1852557 | 8/2008 |
| JP | HEI5-502280 | 4/1993 |
| WO | WO 92/04507 | 3/1992 |
| WO | WO 2007/027639 | 3/2007 |
| WO | WO 2011/053624 | 5/2011 |

OTHER PUBLICATIONS

Declaration of Dr. John De Wit re AU Patent Application No. 2016253640 opposition by CQMS Pty Ltd., 13 pages, dated Jun. 27, 2019.

Declaration of Dr. John De Wit re AU Patent Application No. 2016253640 opposition by CQMS Pty Ltd., 7 pages, dated Oct. 25, 2018.

Declaration of Terry Lee Briscoe re AU Patent Application No. 2016253640 opposition by CQMS Pty Ltd., 56 pages, dated Feb. 4, 2019.

Exhibits to Declaration of Benjamin David Hughes re AU Patent Application No. 2016253640 opposition by CQMS Pty Ltd., 22 pages, dated Oct. 10, 2018.

Exhibits to Declaration of Dr. John De Wit re AU Patent Application No. 2016253640 opposition by CQMS Pty Ltd., 143 pages, dated Oct. 25, 2018.

* cited by examiner

WEAR ASSEMBLY

This application is a divisional of pending application Ser. No. 14/838,117, filed Aug. 27, 2015, which is a Divisional of application Ser. No. 13/547,353, filed Jul. 12, 2012, now U.S. Pat. No. 9,222,243, issued Dec. 29, 2015, which claims priority benefits based upon U.S. Provisional Patent Application No. 61/507,726, filed Jul. 14, 2011, and U.S. Provisional Patent Application No. 61/576,929, filed Dec. 16, 2011, all entitled "Wear Assembly." These earlier priority applications are incorporated herein by reference each in their entirety.

FIELD OF THE INVENTION

The present invention pertains to a wear assembly for use on various kinds of earth working equipment.

BACKGROUND OF THE INVENTION

In mining and construction, wear parts are commonly provided along the digging edge of excavating equipment such as buckets for dragline machines, cable shovels, face shovels, hydraulic excavators, and the like. The wear parts protect the underlying equipment from undue wear and, in some cases, also perform other functions such as breaking up the ground ahead of the digging edge. During use, the wear parts typically encounter heavy loading and highly abrasive conditions. As a result, they must be periodically replaced.

These wear parts usually comprise two or more components such as a base that is secured to the digging edge, and a wear member that mounts on the base to engage the ground. The wear member tends to wear out more quickly and is typically replaced a number of times before the base must also be replaced. One example of such a wear part is an excavating tooth that is attached to the lip of a bucket for an excavating machine. A tooth typically includes an adapter secured to the lip of a bucket and a point attached to the adapter to initiate contact with the ground. A pin or other kind of lock is used to secure the point to the adapter. Improvements in strength, stability, durability, safety, and ease of installation and replacement are desired in such wear assemblies.

SUMMARY OF THE INVENTION

The present invention pertains to a wear assembly for use on various kinds of earth working equipment including, for example, excavating machines and ground conveying means.

In one aspect of the invention, the wear assembly includes a base with a supporting portion, a wear member with a cavity into which the supporting portion is received, and a lock to releasably secure the wear member to the base. The supporting portion is formed with top and bottom recesses that receive complementary projections of the wear member. These recesses and projections include aligned holes so as to receive and position the lock centrally within the wear assembly and remote from the wear surface. This arrangement shields the lock from abrasive contact with the ground and lessens the risk of ejection or loss of the lock.

In another aspect of the present invention, the wear assembly includes a base with a supporting portion and a wear member with a cavity to receive the supporting portion. The fit between the supporting portion and the wear member includes stabilizing surfaces along each of the top, bottom and side walls in a unique configuration that creates a highly stable mounting of the wear member with improved penetrability.

In another aspect of the present invention, the wear member includes a wear indicator depression that opens in the nose-receiving cavity and is initially closed and spaced from the external wear surface, but which breaks through the wear surface when it is time to replace the wear member because of wear.

In another aspect of the invention, the wear member includes a hole for receiving the lock to secure the wear member to the base. The hole is defined by a wall that includes a retaining structure provided with an upper bearing surface and a lower bearing surface for contacting and retaining the lock against upward and downward movement in the hole. In one preferred construction, a passage is provided in the hole to enable a lock or lock component to fit into the hole as an integral unit and be positioned to contact the upper and lower bearing surfaces of the retaining structure.

In another aspect of the invention, the lock includes a mounting component provided with a securing structure for attachment within a hole in the wear member. The securing structure cooperates with a retaining structure within the hole to resist movement of the mounting component in and out of the hole during use. The mounting component defines a threaded opening for receiving a threaded pin that is used to releasably hold the wear member to the base. The separate mounting component can be easily manufactured and secured within the wear member for less expense and higher quality than forming the threads directly in the wear member. The mounting component can be mechanically held within the hole in the wear member to resist axial movement in either direction so as to avoid unintended loss of the lock.

In another aspect of the invention, the lock includes a mounting component received and mechanically secured into a hole in the wear member to resist axial movement, a locking component movably received in the mounting component to releasably secure a wear member to a base, and a retainer to prevent release of the mounting component from the wear member.

In another aspect of the invention, the lock includes threaded components that are mechanically secured to a hardened steel wear member. The lock component can be adjusted between two positions with respect to the wear member: a first position where the wear member can be installed or removed from the base, and a second position where the wear member is secured to the base by the lock. The lock is preferably securable to the wear member by mechanical means at the time of manufacture so that it can be shipped, stored and installed as an integral unit with the wear member, i.e., with the lock in a "ready to install" position. Once the wear member is placed onto the base, the lock is moved to a second position to retain the wear member in place for use in an earth working operation.

In another aspect of the invention, a lock for releasably securing a wear member to earth working equipment includes a threaded pin with a socket in one end for receiving a tool to rotate the pin. The socket includes facets for receiving the tool, and a clearance space in lieu of one of the facets to better avoid and clean out earthen fines from the socket.

DETAILED DESCRIPTION OF THE PREFERRED EMBODIMENTS

The present invention pertains to a wear assembly for various kinds of earth working equipment including, for example, excavating equipment and ground conveying equipment. Excavating equipment is intended as a general term to refer to any of a variety of excavating machines used in mining, construction and other activities, and which, for example, include dragline machines, cable shovels, face shovels, hydraulic excavators, and dredge cutters. Excavating equipment also refers to the ground-engaging components of these machines such as the bucket or the cutter head. The digging edge is that portion of the equipment that leads the contact with the ground. One example of a digging edge is the lip of a bucket. Ground conveying equipment is also intended as a general term to refer to a variety of equipment that is used to convey earthen material and which, for example, includes chutes and mining truck beds. The present invention is suited for use along the digging edge of excavating equipment in the form of, for example, excavating teeth and shrouds. Additionally, certain aspects of the present invention are also suited for use along the expanse of a wear surface in the form of, for example, runners.

Relative terms such as front, rear, top, bottom and the like are used for convenience of discussion. The terms front or forward are generally used to indicate the normal direction of travel during use (e.g., while digging), and upper or top are generally used as a reference to the surface over which the material passes when, for example, it is gathered into the bucket. Nevertheless, it is recognized that in the operation of various earth working machines the wear assemblies may be oriented in various ways and move in all kinds of directions during use.

Figure 1:
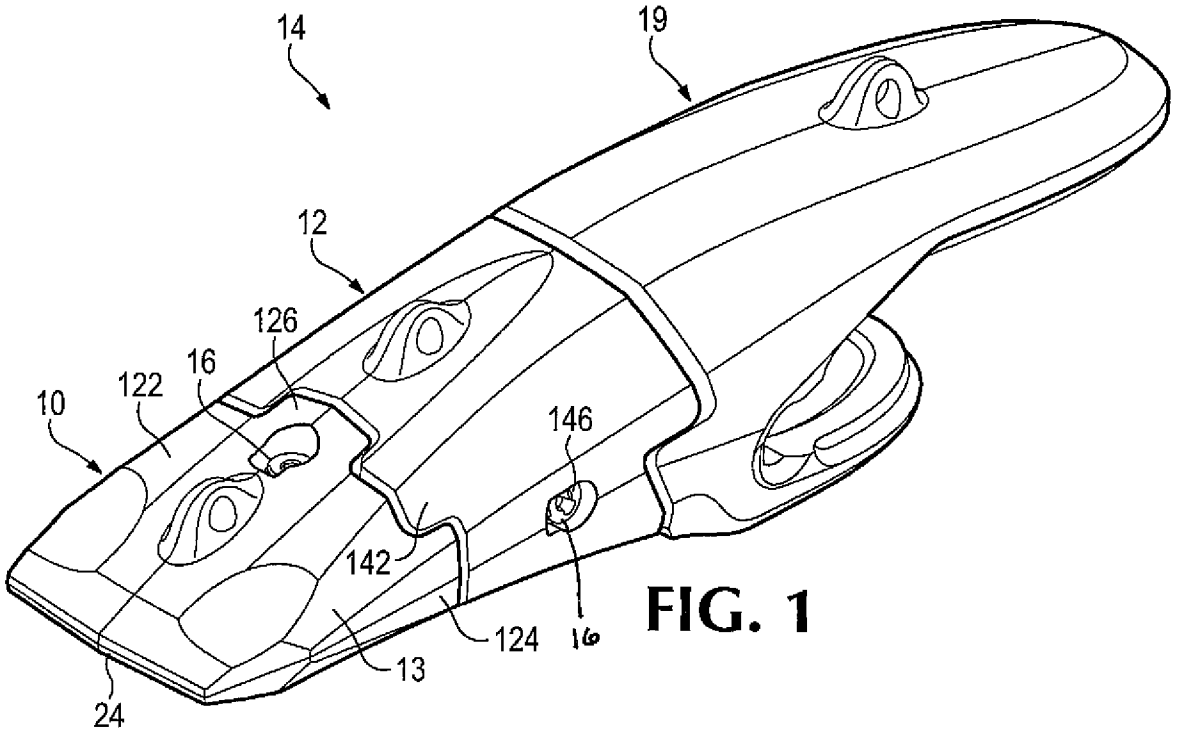
FIG. 1 is a perspective view of a wear assembly in accordance with the present invention.
Figure 2:
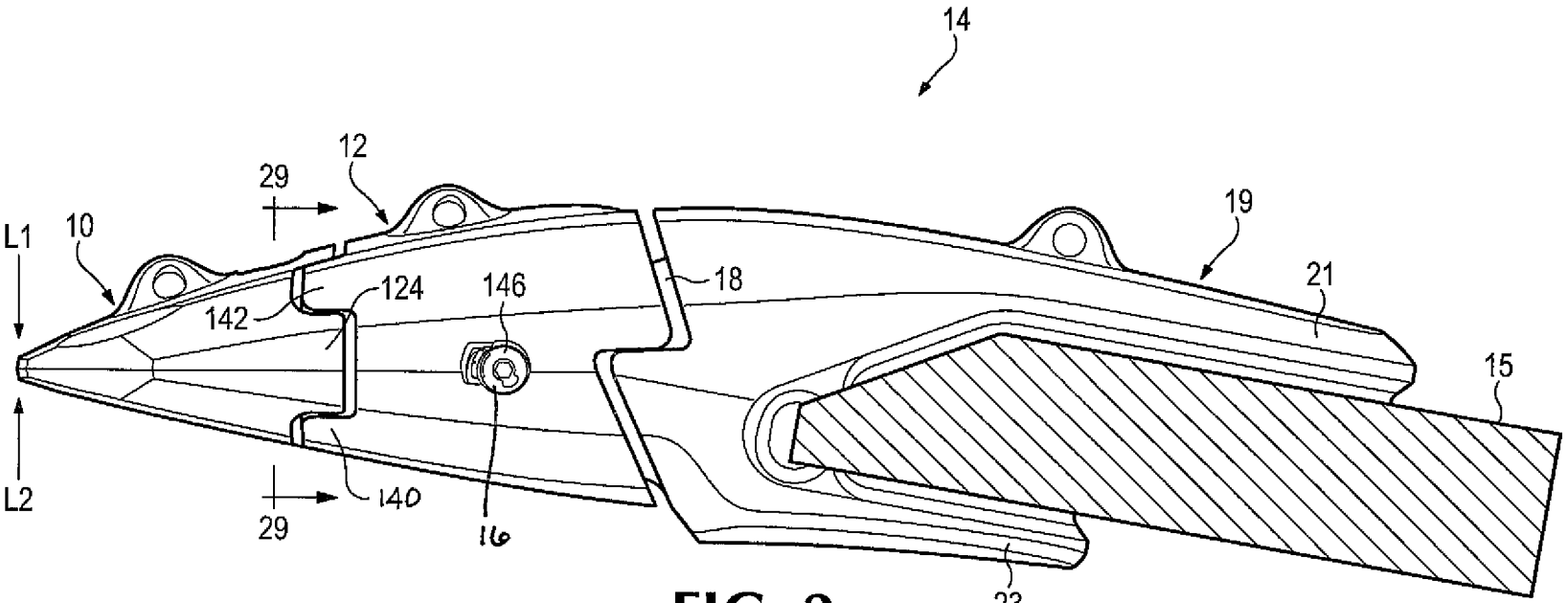
FIG. 2 is a side view of the wear assembly.
Figure 3:
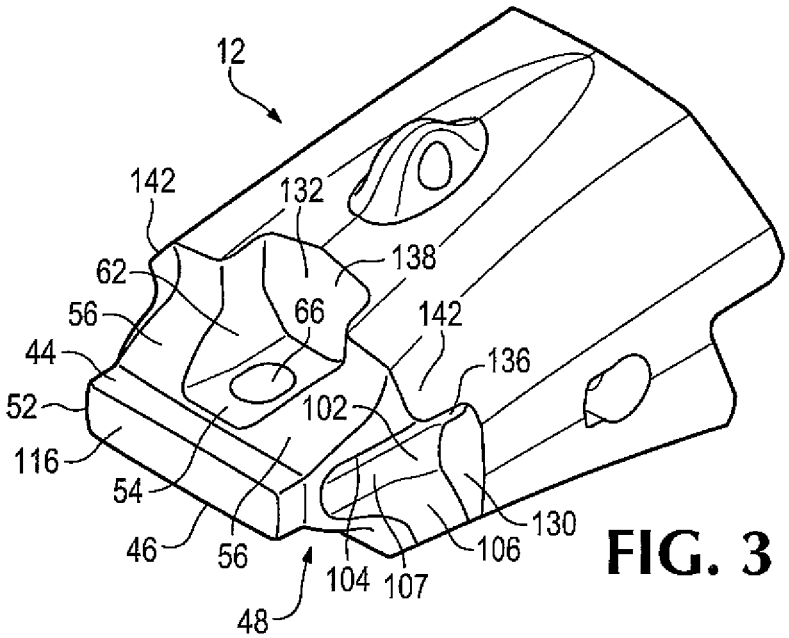
FIG. 3 is a perspective view of a base for the wear assembly.
Figure 4:
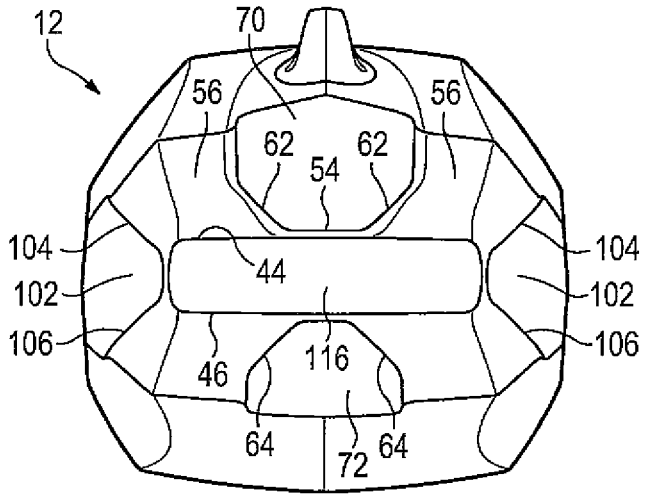
FIG. 4 is a front view of the base.
Figure 5:
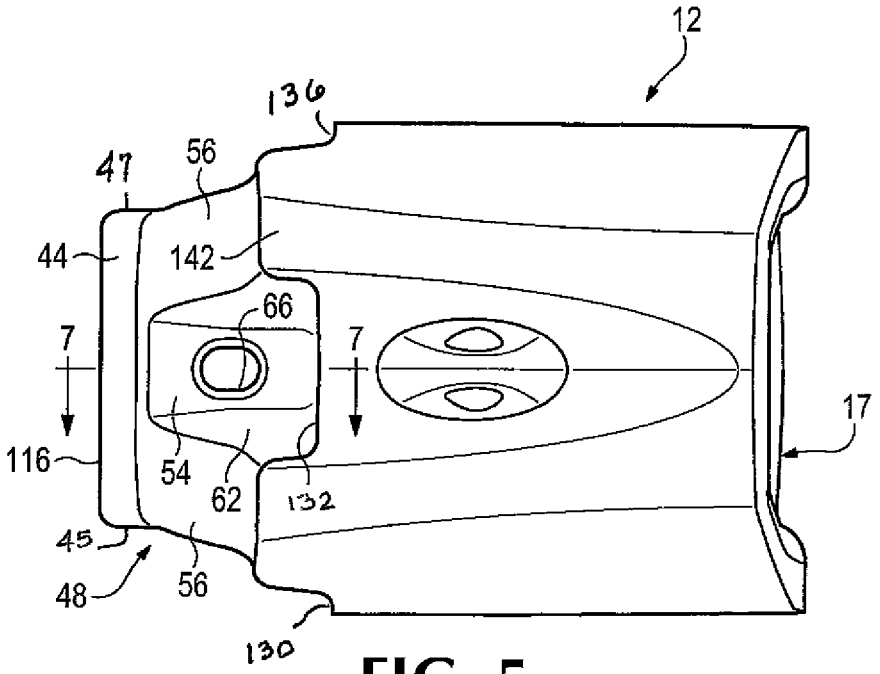
FIG. 5 is a top view of the base.
Figure 6:
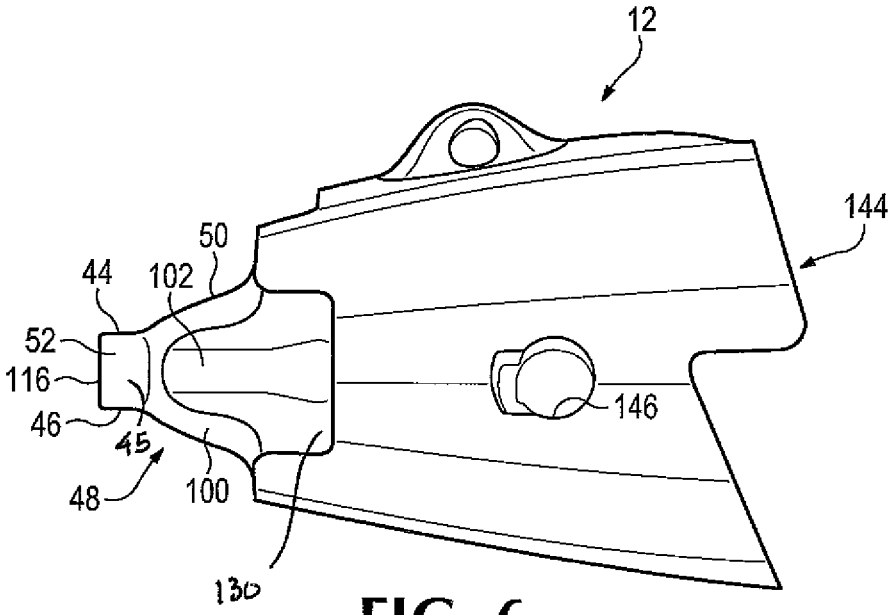
FIG. 6 is a side view of the base.
Figure 7:
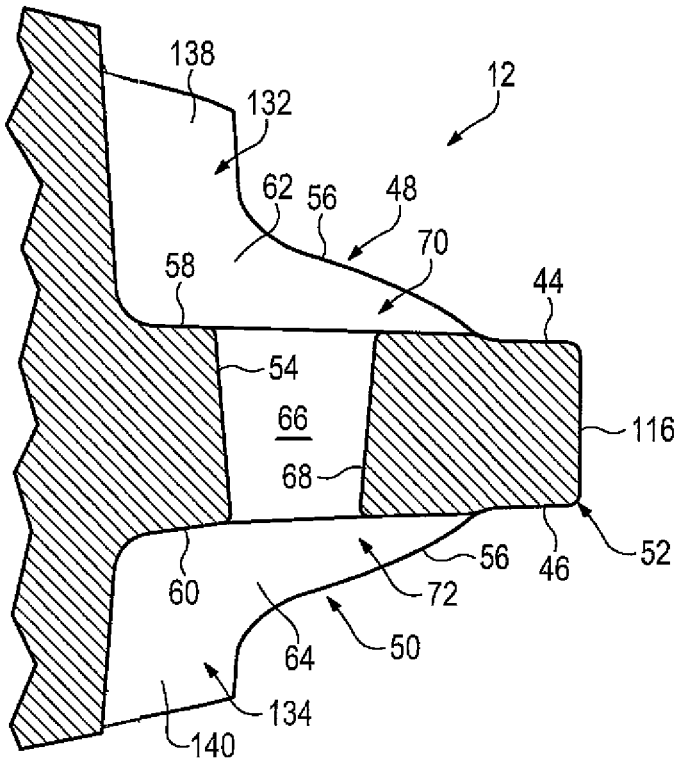
FIG. 7 is a cross-sectional view taken along line 7-7 in FIG. 5.
Figure 8:
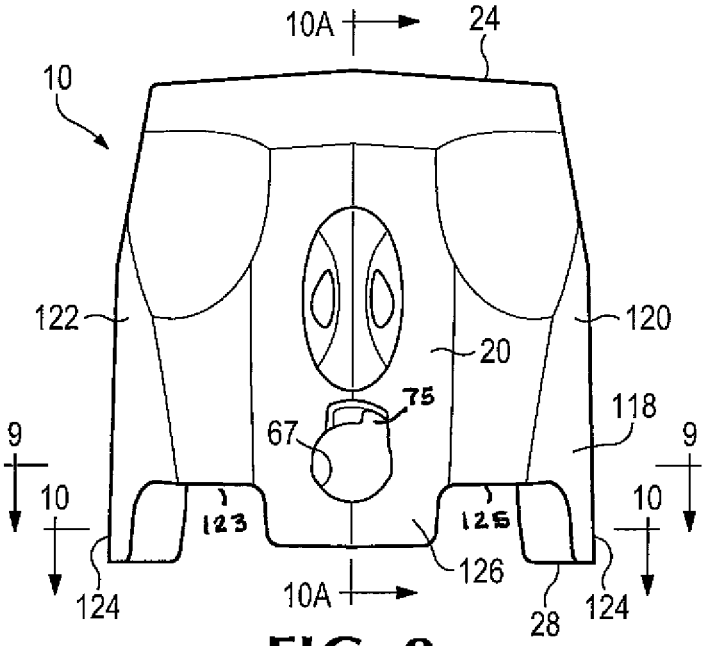
FIG. 8 is a top view of a wear member for the wear assembly.
Figure 9:
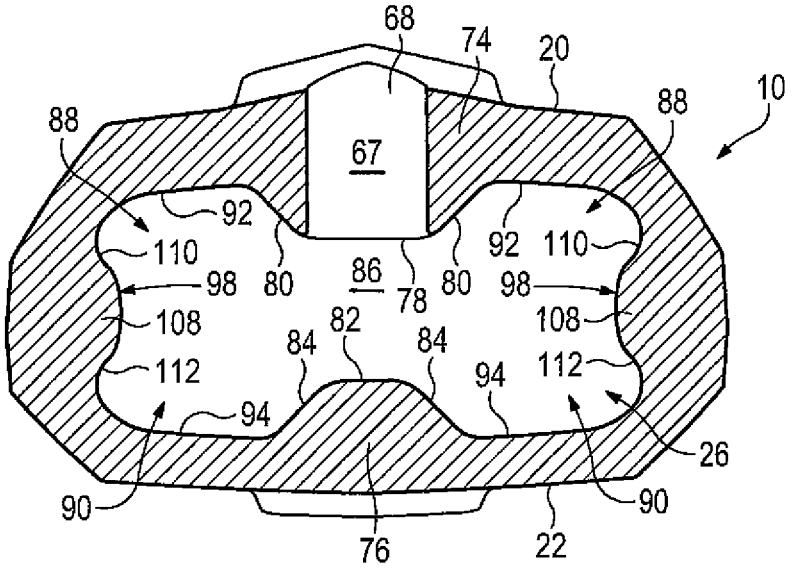
FIG. 9 is a cross-sectional view taken along line 9-9 in FIG. 8.
Figure 10:
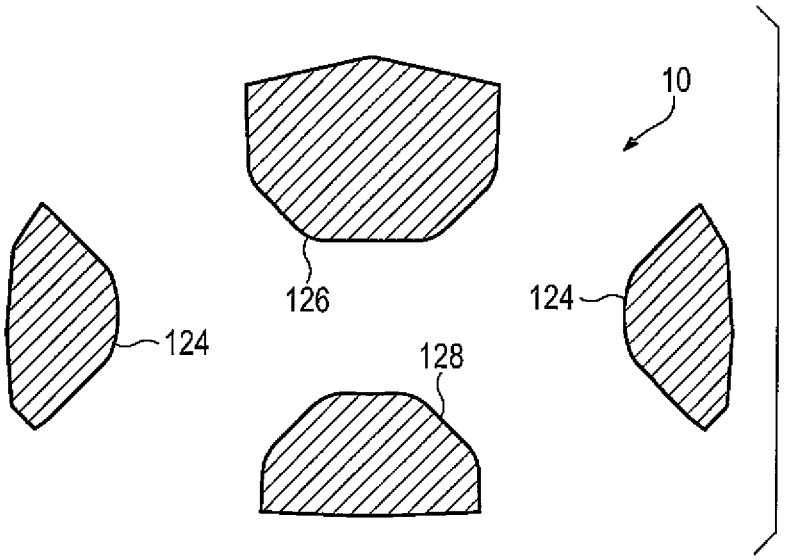
FIG. 10 is a cross-sectional view taken along line 10-10 in FIG. 8.
Figure 10A:
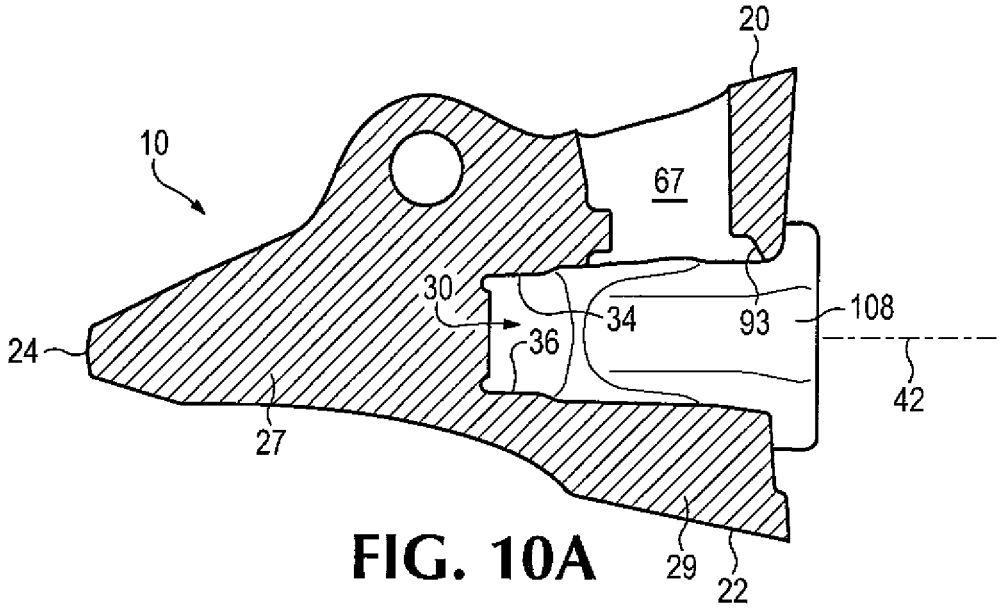
FIG. 10A is a cross-sectional view taken along line 10A-10A in FIG. 8.
Figure 11:
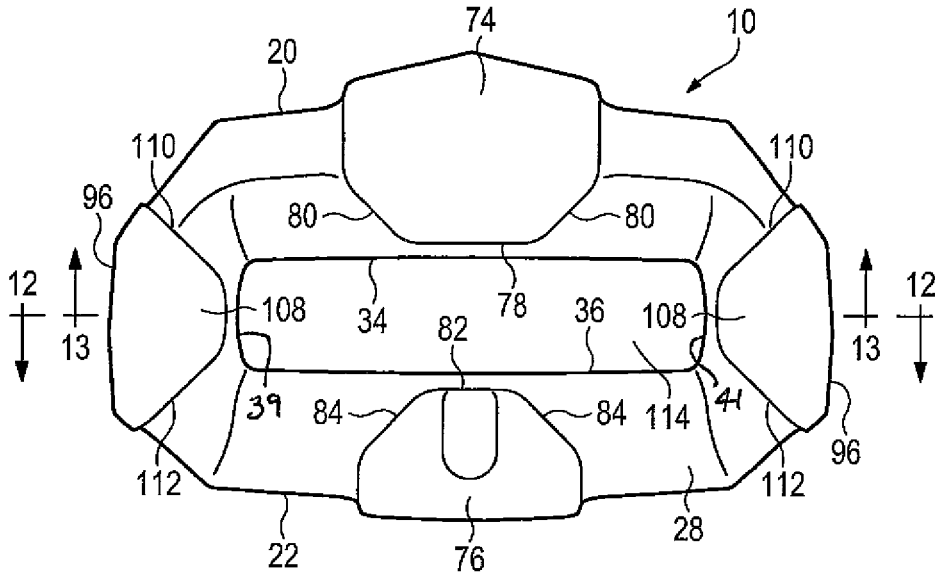
FIG. 11 is a rear view of the wear member.
Figure 12:
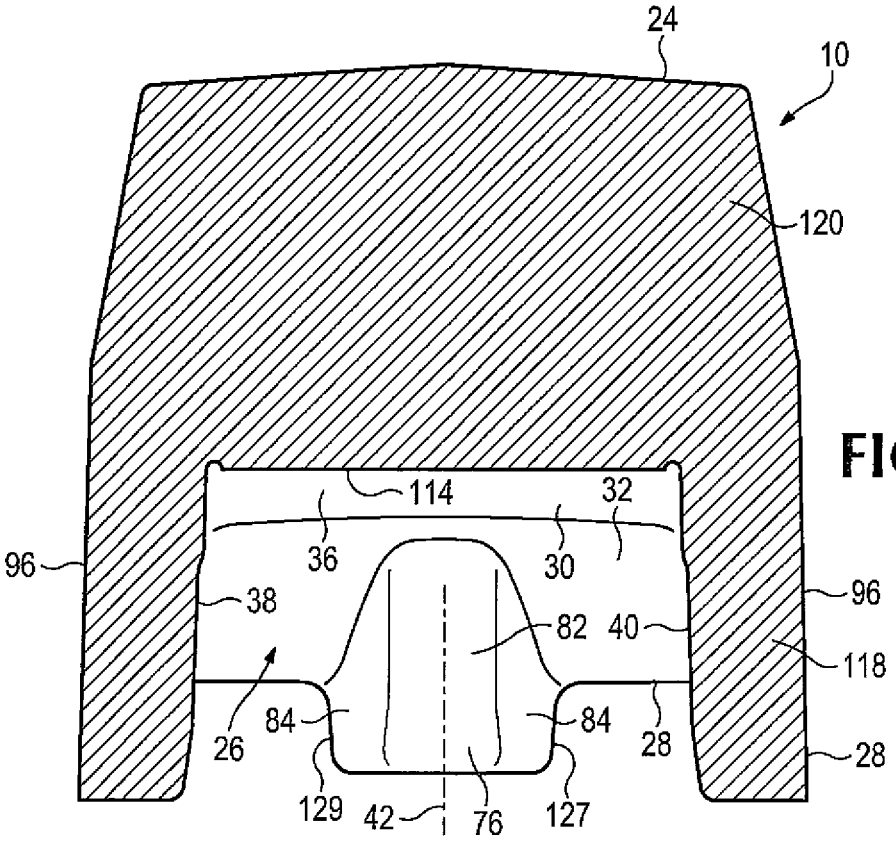
FIG. 12 is a cross-sectional view taken along line 12-12 in FIG. 11.
Figure 13:
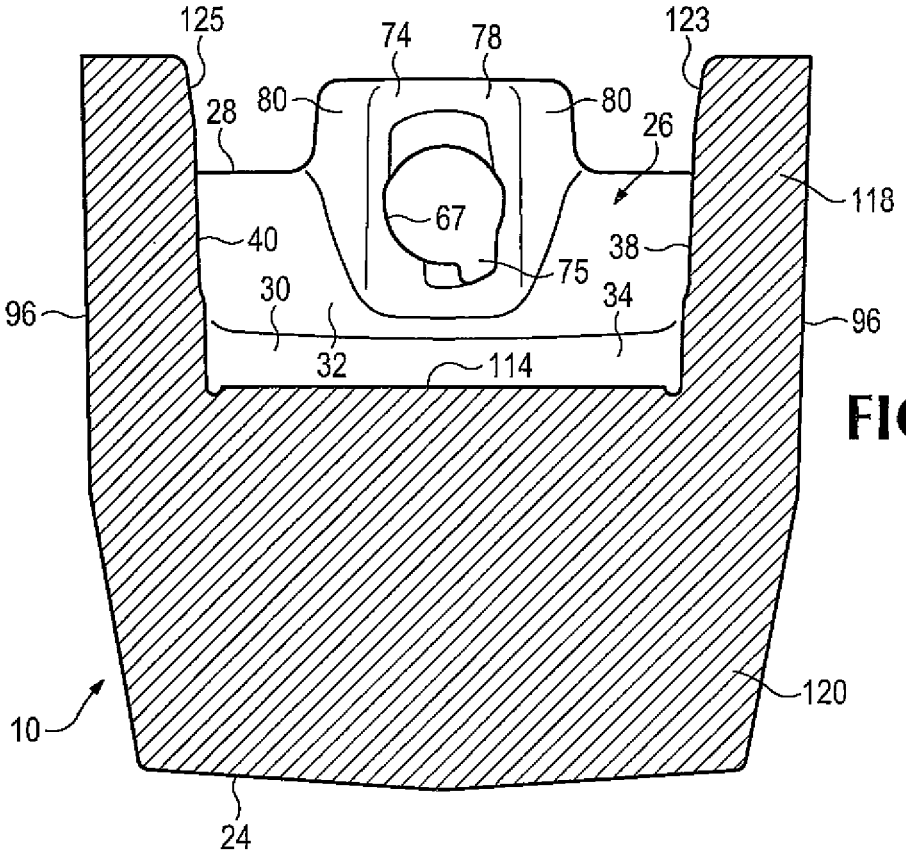
FIG. 13 is a cross-sectional view taken along line 13-13 in FIG. 11.
Figure 14:
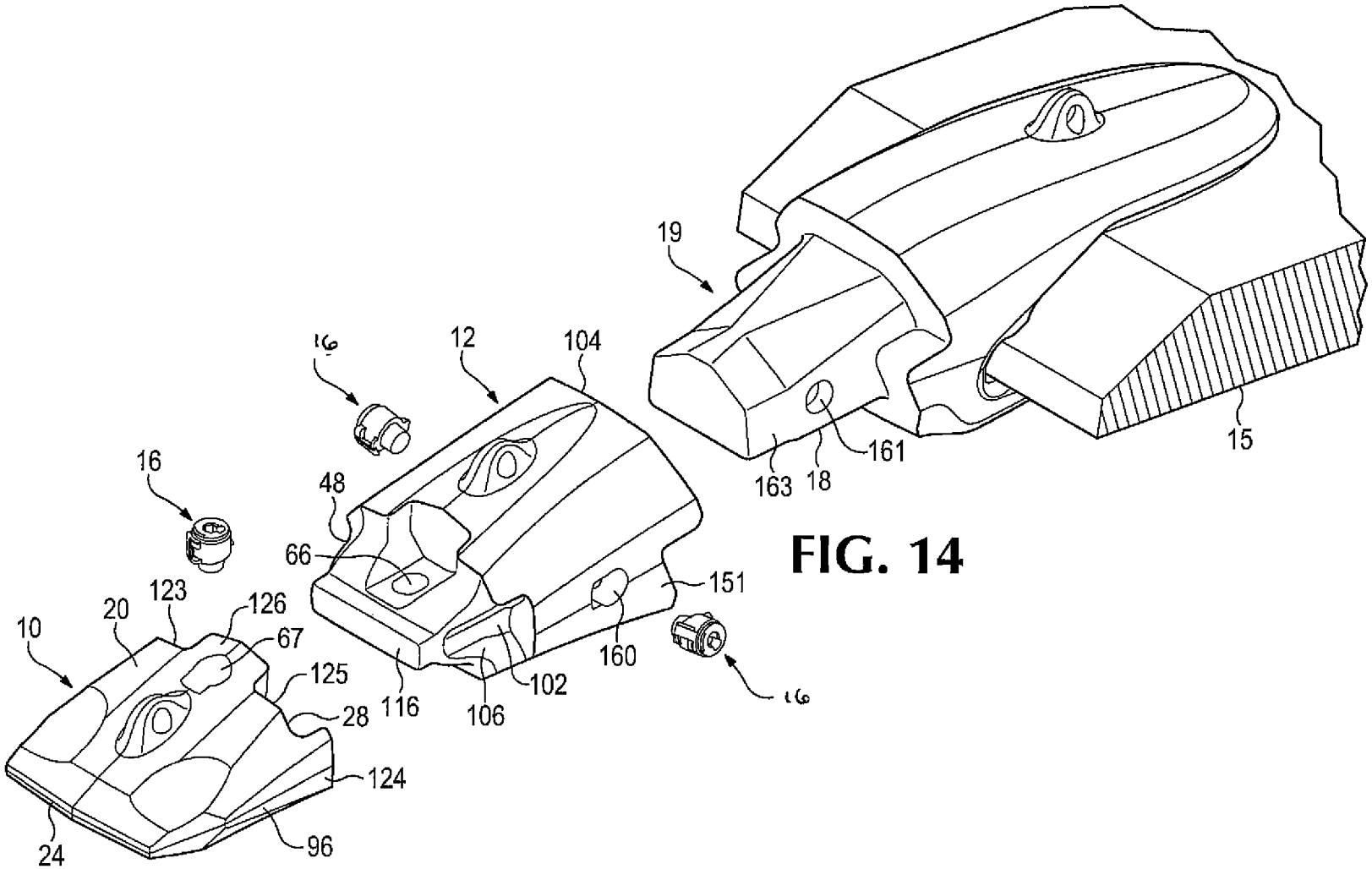
FIG. 14 is an exploded, perspective view of the wear assembly.
Figure 15:
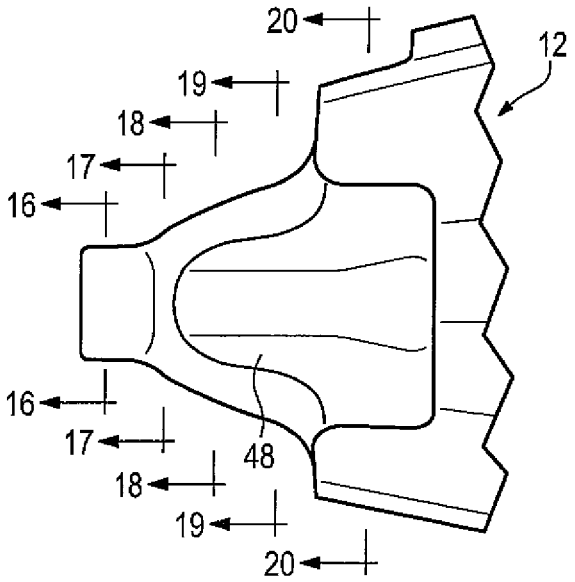
FIG. 15 is a partial side view of the base.
Figure 16:
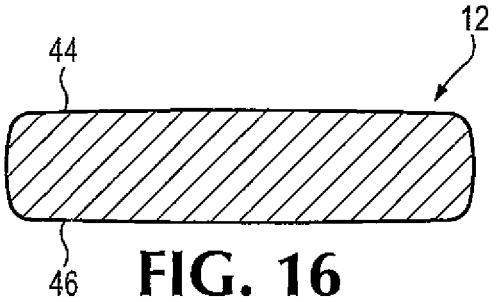
FIG. 16 is a cross-sectional view taken along line 16-16 in FIG. 15.
Figure 17:
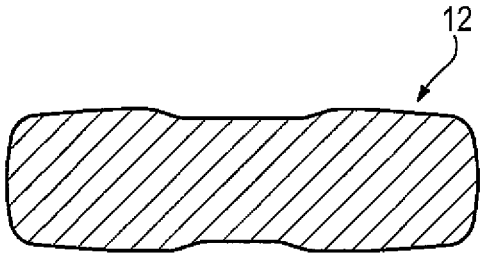
FIG. 17 is a cross-sectional view taken along line 17-17 in FIG. 15.

In one example, a wear assembly 14 in accordance with the present invention is an excavating tooth that attaches to a lip 15 of a bucket (FIGS. 1, 2 and 14). The illustrated tooth 14 includes an adapter 19 welded to lip 15, an intermediate adapter 12 mounted on adapter 19, and a point (also called a tip) 10 mounted on base 12. While one tooth construction is shown, other tooth arrangements using some or all of the aspects of the invention are possible. For example, adapter 19 in this embodiment is welded to lip 15, but it could be mechanically attached (e.g., by a Whisler-style lock assembly). In addition, the base could be an integral portion of the excavating equipment rather than a separately attached component. For example, adapter 19 could be replaced by an integral nose of a cast lip. Although in this application, for purposes of explanation, the intermediate adapter 12 is referred to as the base and the point 10 as the wear member, the intermediate adapter 12 could be considered the wear member and the adapter 19 the base.

Adapter 19 includes a pair of legs 21, 23 that straddle lip 15, and a forwardly projecting nose 18. The intermediate adapter 12 includes a rearwardly-opening cavity 17 to receive nose 18 at the front end of adapter 19 (FIGS. 1, 2, 5 and 14). Cavity 17 and nose 18 are preferably configured as disclosed in U.S. Pat. No. 7,882,649 which is incorporated herein by reference, but other nose and cavity constructions could be used. Adapter 12 includes a forwardly-projecting nose 48 to mount point 10. Point 10 includes a rearwardly-opening cavity 26 to receive nose 48, and a front end 24 to penetrate the ground. Lock 16 is used to secure wear member 10 to base 12, and base 12 to nose 18 (FIGS. 1, 2 and 14). In this example, the locks to secure both the wear member 10 to base 12, and the base 12 to nose 18 are the same. Nevertheless, they could be dimensioned differently, have different constructions, or could be completely different locks. With the use of an intermediate adapter, the tooth is well suited for use on larger machines, but could also be used on smaller machines. As an alternative, a point as the wear member could be secured directly onto adapter 19 as the base.

Wear member 10, in this embodiment, has a generally wedge-shaped configuration with a top wall 20 and a bottom wall 22 that converge to a narrow front end 24 to engage and penetrate the ground during operation of the equipment (FIGS. 1, 2 and 8-14). A cavity 26 opens in the rear end 28 of wear member 10 for receiving base 12. Cavity 26 preferably includes a front end portion 30 and a rear end portion 32. The front or working portion 27 of wear member 10 is that portion forward of cavity 26. The rear or mounting portion 29 of wear member 10 is that portion that includes cavity 26.

The front end portion 30 of cavity 26 (FIGS. 10-13) includes upper and lower stabilizing surfaces 34, 36. Stabilizing surfaces 34, 36 axially extend substantially parallel to the longitudinal axis 42 of cavity 26 for improved stability under vertical loads (i.e., loads that include a vertical component). The term "substantially parallel" in this application means actually parallel or at a small diverging angle (i.e., about 7 degrees or less). Accordingly, stabilizing surfaces 34, 36 axially extend at an angle of about 7 degrees or less to longitudinal axis 42. Preferably, the stabilizing surfaces axially diverge rearwardly from the longitudinal axis at an angle of about five degrees or less, and most preferably at an angle of 2-3 degrees.

Figure 24:
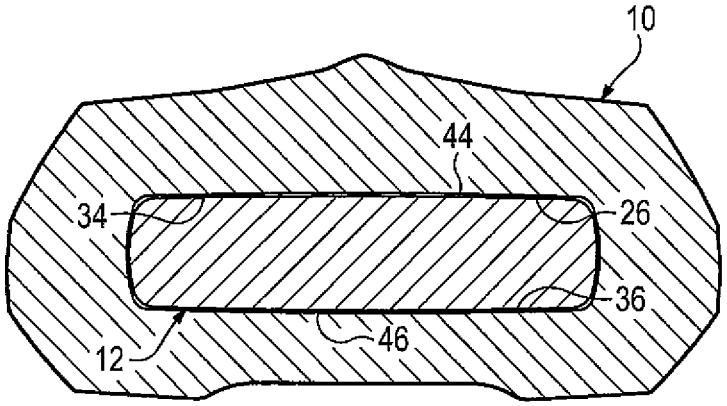
FIG. 24 is a cross-sectional view taken along line 24-24 in FIG. 21.

Stabilizing surfaces 34, 36 oppose and bear against complementary stabilizing surfaces 44, 46 on the nose 48 of base 12 (FIG. 24). Stabilizing surfaces 44, 46 are also substantially parallel to longitudinal axis 42 when the components are assembled together (FIGS. 3-7, 14-16 and 24). The bearing of stabilizing surfaces 34, 36 in cavity 26 against stabilizing surfaces 44, 46 on nose 48 provides a stable mounting of wear member 10 under vertical loads. Vertical loads applied to the front end 24 of wear member 10 urge the wear member (if not restricted by the nose and lock) to roll forward and off of the nose. Stabilizing surfaces (i.e., surfaces that are substantially parallel to the longitudinal axis 42) resist this urge more effectively than surfaces with greater axial inclinations, and provide a more stable mounting of wear member 10 on nose 48. A more stable mounting enables the use of a smaller lock and results in less internal wear between the parts.

Front end portion 30 of cavity 26 further includes side bearing surfaces 39, 41 to contact complementary side bearing surfaces 45, 47 on nose 48 to resist side loads (i.e., loads with a side component). Side bearing surfaces 39, 41 in cavity 26 and side bearing surfaces 45, 47 on nose 48 preferably axially extend substantially parallel to longitudinal axis 42 for greater stability in the mounting of wear member 10. These front side bearing surfaces 39, 41, 45, 47 cooperate with rear bearing surfaces that also resist side loads (as discussed below). In the preferred embodiment, the front bearing surfaces 34, 36, 39, 41 in cavity 26 are each formed with slight lateral concave curvature for better resisting shifting loads and loads from all directions. Front bearing surfaces 44-47 on nose 48 would have a complementary convex configuration. The front bearing surfaces in cavity 26 and on nose 48 could, however, be flat or formed with a different curvature.

Nose 48 of base 12 includes a rear or main portion 50 rearward of stabilizing surfaces 44, 46 of the front end 52 (FIGS. 3-7 and 14-20); the nose 48 is considered that portion of adapter 12 that is received into cavity 26 of wear member 10. The main portion 50 generally has a "dog bone" configuration in cross section (FIGS. 18-20) with a narrower central section 54 and larger or thicker side sections 56. Such a construction resembles an I-beam construction in function, and provides an attractive balance of strength with reduced mass and weight. In the preferred embodiment, side sections 56 are the mirror image of each other. The side sections 56 gradually increase in thickness from front to back for increased strength and reduced stress in the design. The use of a nose 48 having a narrow center section 54 and enlarged side sections 56 provides the dual benefit of (i) the nose 48 having sufficient strength to withstand the heavy loading that may be encountered during operation, and (ii) positioning the lock 16 at a central location in the wear assembly 14 to shield it from abrasive contact with the ground during use and to reduce the risk of lock ejection. The central section 54 preferably represents about the central two thirds or less of the overall thickness (i.e., height) of the nose 48 along the same lateral plane. In a most preferred embodiment, the thickness of central section 54 is about 60% or less of the largest or overall thickness of nose 48 along the same lateral plane.

Figure 20:
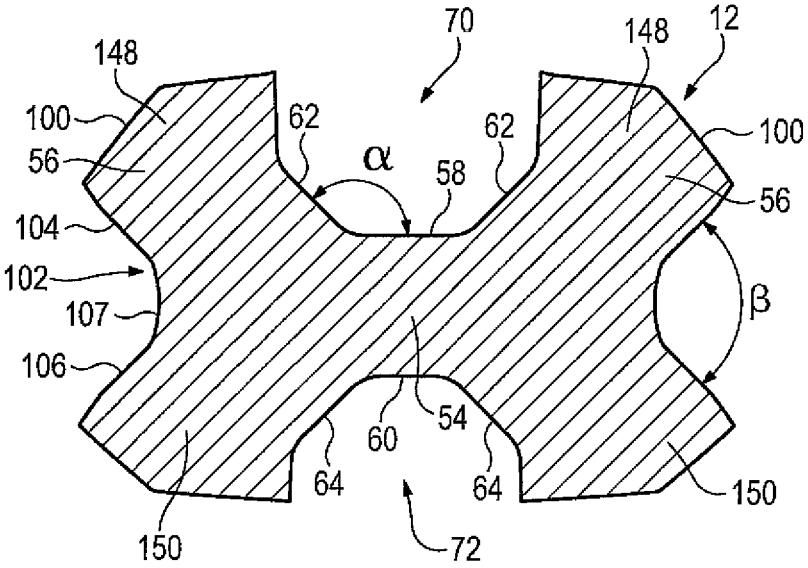
FIG. 20 is a cross-sectional view taken along line 20-20 in FIG. 15.
Figure 21:
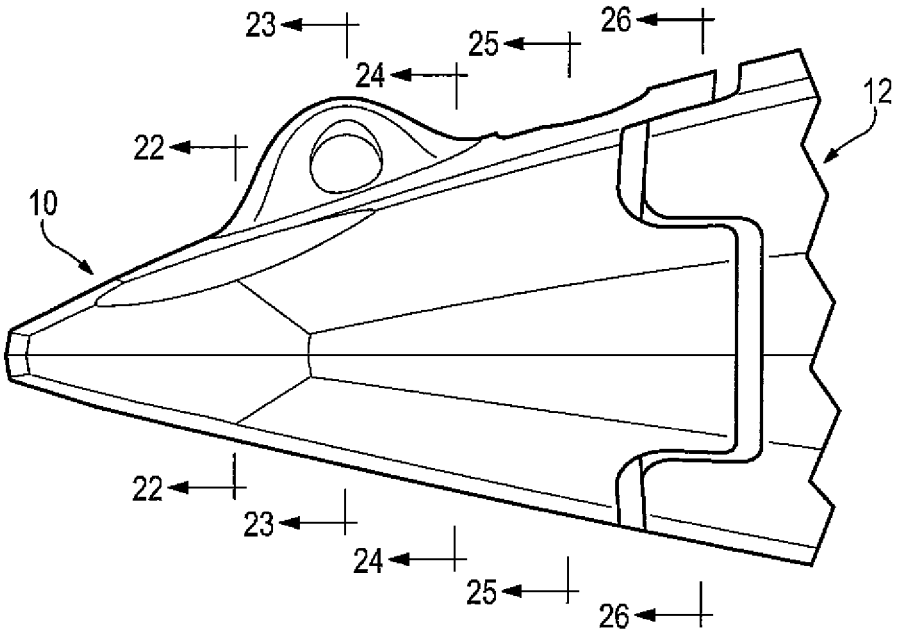
FIG. 21 is a partial side view of the wear assembly.
Figure 22:
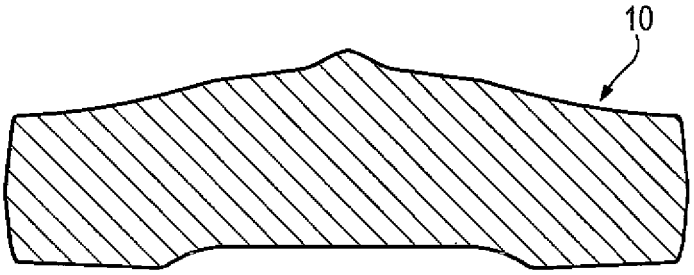
FIG. 22 is a cross-sectional view taken along line 22-22 in FIG. 21.
Figure 23:
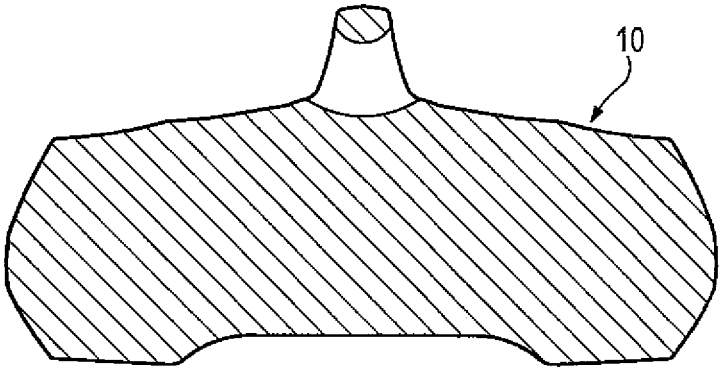
FIG. 23 is a cross-sectional view taken along line 23-23 in FIG. 21.

Central section 54 is defined by a top surface 58 and a bottom surface 60. Top and bottom surfaces 58, 60 preferably axially extend substantially parallel to longitudinal axis 42, but they could have a greater inclination. Top surface 58, on each side, blends into an inner surface 62 on side sections 56. Inner surfaces 62 are laterally inclined upward and outward from top surface 58 to partially define the upper part of side sections 56. Likewise, inner surfaces 64 are laterally inclined downward and outward from bottom surface 60 to partially define the lower part of side sections 56. Inner surfaces 62 are each laterally inclined to top surface 58 at an angle $\alpha$ of about 130-140 degrees to resist both vertical and side loading on wear member 10, and reduce stress concentrations during loading (FIG. 20). However, they could be at an angle outside of this range (e.g., about 105-165 degrees) if desired. Inner surfaces 64 are preferably mirror images of inner surfaces 62, but they could be different if desired. The preferred ranges of inclinations are the same for both sets of inner surfaces 62, 64. The most preferred inclination for each inner surface 62, 64 is at an angle $\alpha$ of 135 degrees. In some constructions, it may be preferred to have each inner surface 62, 64 inclined at an angle $\alpha$ of more than 135 degrees to the adjacent top or bottom surface to provide greater resistance to vertical loads. Inner surfaces 62, 64 are preferably stabilizing surfaces that each axially extend substantially parallel to the longitudinal axis 42 to better resist vertical loads and provide a stable mounting of the wear member 10 on base 12.

Figure 25:
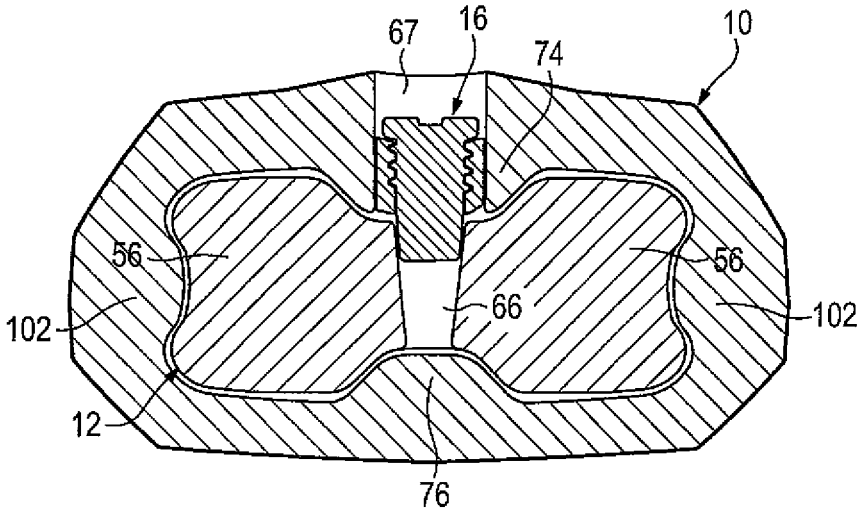
FIG. 25 is a cross-sectional view taken along line 25-25 in FIG. 21.
Figure 29:
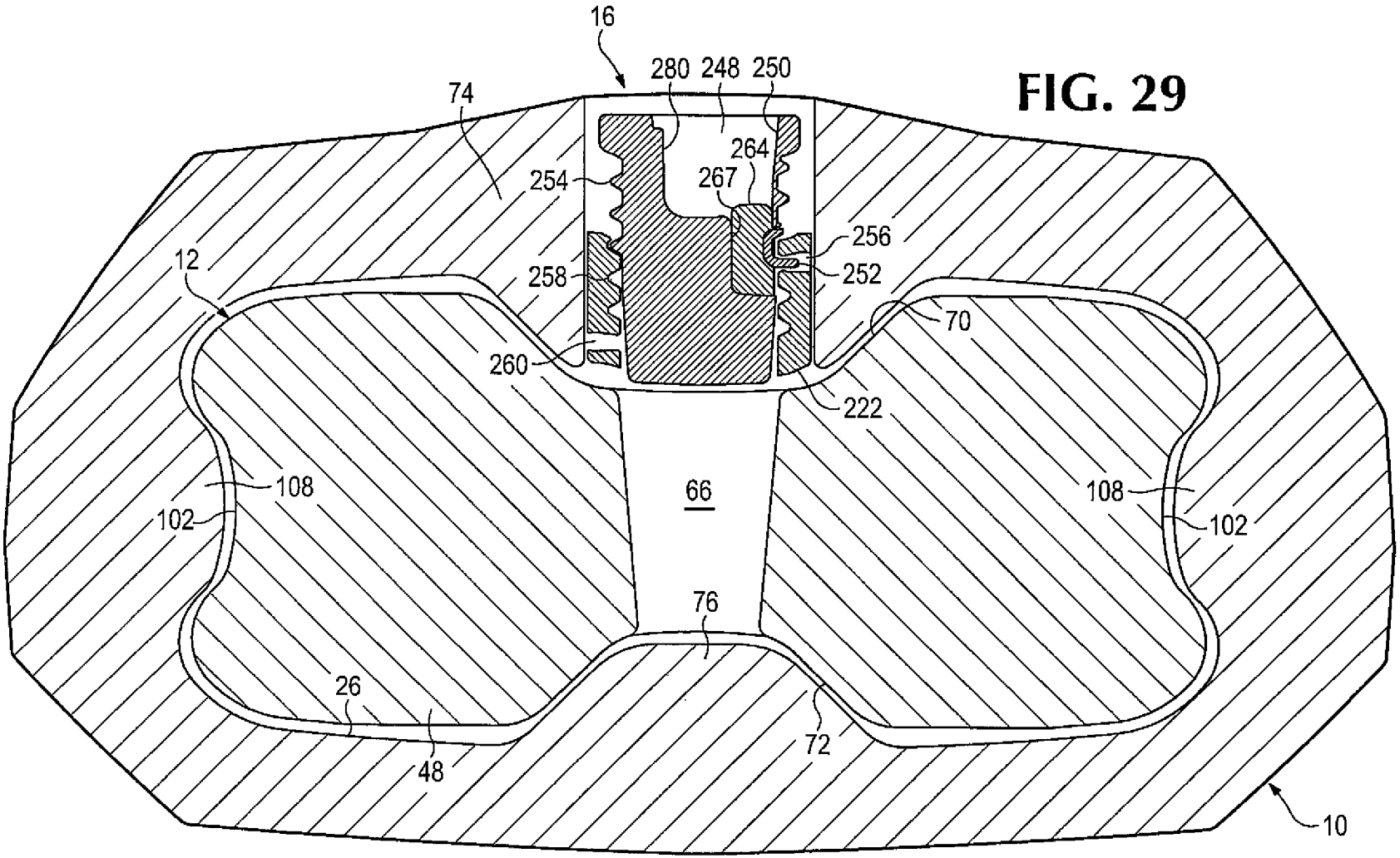
FIG. 29 is a cross-sectional view taken along line 29-29 in FIG. 2 with the lock in the release position.
Figure 30:
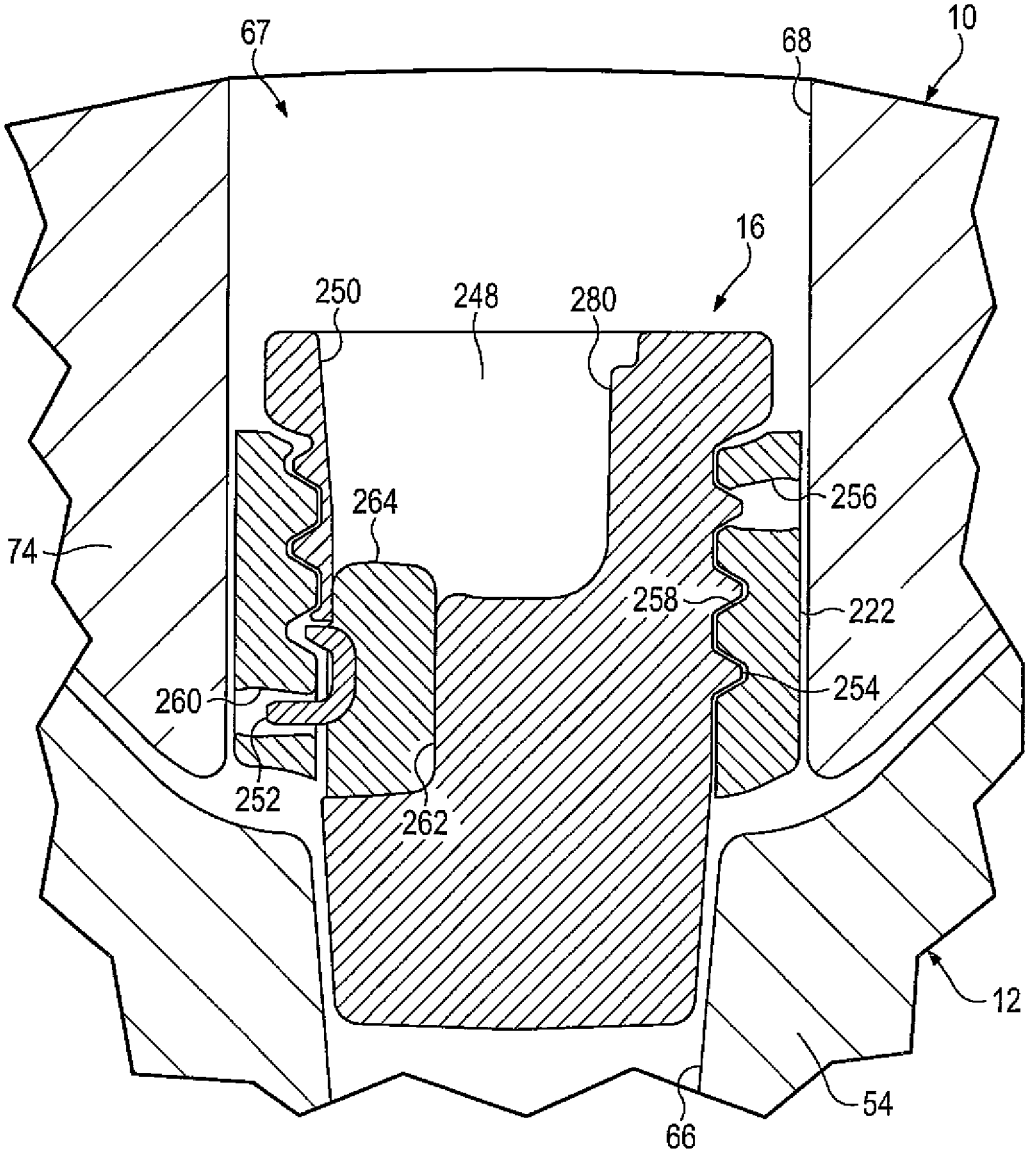
FIG. 30 is a partial cross-sectional view taken along line 29-29 in FIG. 2 with the lock in the locked position.

A central hole 66 is formed in central section 54 that opens in top and bottom surfaces 58, 60 (FIGS. 3, 5, 7, 19, 25 and 29), though it could open only in top surface 58 if desired. The downward extension of hole 66 through bottom surface 60 reduces the build-up of earthen fines in the hole and enables an easier cleaning out of the fines in the hole. Top wall 20 of wear member 10 includes a through-hole 67 that aligns with hole 66 when wear member 10 is mounted on nose 48 (FIGS. 1, 9, 10A, 13, 14, 25 and 29). Lock 16 is received into the holes 66, 67 to hold wear member 10 to base 12 (FIGS. 25, 29 and 30). The details of preferred lock 16 are provided below. However, other locks could be used to secure wear member 10 to base 12. As examples, alternative locks could be in the form disclosed in U.S. Pat. No. 7,578,081 or 5,068,986, each of which are incorporated herein by reference. The shape of the aligned holes in the wear member and the base in instances of using alternative locks would, of course, be different than illustrated herein to accommodate the different locks.

Figure 31:
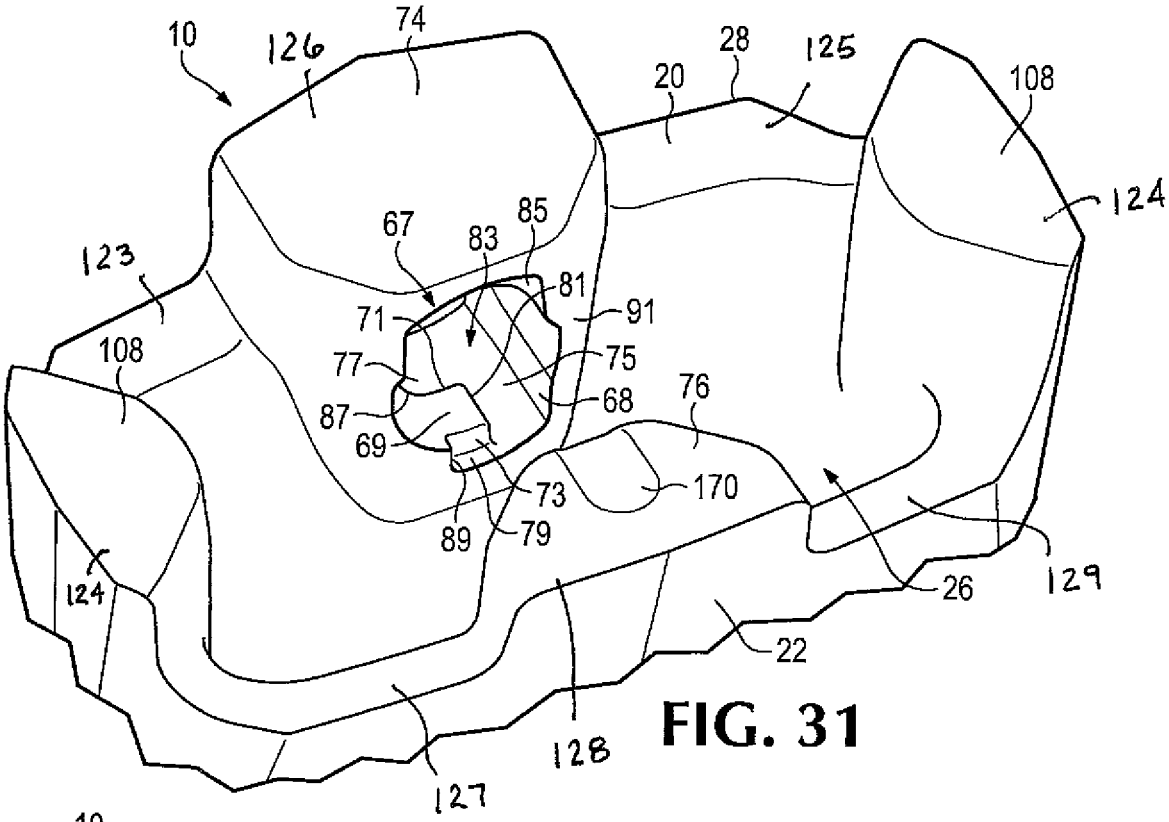
FIG. 31 is a partial perspective view of the wear member.

Hole 67 in wear member 10 is defined by a wall 68 that preferably surrounds the lock 16 (FIG. 31). Wall 68 includes a retaining structure 69 that extends laterally along part of the wall to define an upper bearing surface 71 and a lower bearing surface 73. Bearing surfaces 71, 73 are each contacted by lock 16 to hold the lock in the hole and resist inward and outward vertical forces applied to the lock during shipping, storage, installation and use of the wear member so as to better resist lock ejection or loss. In a preferred embodiment, retaining structure 69 is formed as a radial projection extending into hole 66 from wall 68 wherein the bearing surfaces 71, 73 are formed as upper and lower shoulders. Alternatively, retaining structure 69 could be formed as a recess (not shown) in perimeter wall 68 with upper and lower bearing surfaces that face each other. A passage 75 is provided vertically along wall 68 in hole 67 to enable the insertion of lock 16 and the engagement of retaining structure 69, i.e., with lock 16 in bearing contact with both the upper and lower bearing surfaces 71, 73. In the illustrated embodiment, no hole is formed in the bottom wall 22 of the wear member 10; but a hole could be so formed to enable reversible mounting of point 10. Also, if desired, base 12 could be reversibly mounted on nose 18 if the fit between the base 12 and nose 18 permit it. In the illustrated embodiment, base 12 cannot be reversibly mounted on nose 18.

In a preferred embodiment, retaining structure 69 is essentially a continuation of wall 68 that is defined by a first relief 77 above or outside of the retaining structure 69, a second relief 79 below or inside of the retaining structure 69, and passage 75 at the distal end 81 of retaining structure 69. Reliefs 77, 79 and passage 75, then, define a continuous recess 83 in perimeter wall 68 about retaining structure 69. The end walls 87, 89 of reliefs 77, 79 define stops for the positioning of lock 16. A recess 85 is preferably provided along an inside surface 91 of cavity 26 to function as a stop during the insertion of a mounting component of lock 16 as described below.

Cavity 26 in wear member 10 has a shape that complements nose 48 (FIGS. 9, 10, 10A, 24-26 and 29). Accordingly, the rear end 32 of the cavity includes an upper projection 74 and a lower projection 76 that are received into the upper and lower recesses 70, 72 in nose 48. Upper projection 74 includes an inside surface 78 that opposes top surface 58 on nose 48, and side surfaces 80 that oppose and bear against inner surfaces 62 on nose 48. Preferably there is a gap between inside surface 78 and top surface 58 to ensure contact between side surfaces 80 and inner surfaces 62, but they could be in contact if desired. Side surfaces 80 are laterally inclined to match the lateral inclination of inner surfaces 62. Side surfaces 80 axially extend substantially parallel to the longitudinal axis 42 to match the axial extension of inner surfaces 62.

Lower projection 76 is preferably the mirror image of upper projection 74, and includes an inside surface 82 to oppose bottom surface 60, and side surfaces 84 to oppose and bear against inner surfaces 64. In cavity 26, then, inside surface 78 faces inside surface 82 with gap 86 in between the two inside surfaces 78, 82 that is slightly larger than the thickness of central section 54 of nose 48. The thickness (or height) of gap 86 is preferably within the middle two thirds of the overall thickness (or height) of the cavity (i.e., the largest height) 26 along the same lateral plane, and is most preferred within the middle 60% or less of the overall thickness of the cavity along the same lateral plane. Side surfaces 80, 84 are laterally inclined away from the respective inside surfaces 78, 82, and axially extending substantially parallel to the longitudinal axis 42 to define upper and lower rear stabilizing surfaces for the point. The front stabilizing surfaces 34, 36 cooperate with rear stabilizing surfaces 80, 84 to stably support wear member 10 on nose 48. For example, a downward vertical load L1 on the front end 24 of wear member 10 (FIG. 2) is primarily resisted by front stabilizing surface 34 in cavity 26 bearing against front stabilizing surface 44 on nose 48, and rear stabilizing surfaces 84 in cavity 26 bearing against rear stabilizing surfaces 64 on nose 48 (FIGS. 24-26 and 29). The axial extension of these stabilizing surfaces 34, 44, 64, 86 (i.e., that they are axially substantially parallel to the longitudinal axis 42) minimizes the forward, downward tendency to roll that load L1 urges on wear member 10. Likewise, an opposite upward load L2 on front end 24 (FIG. 2) would be primarily resisted by front stabilizing surface 36 in cavity 26 bearing against front stabilizing surface 46 on nose 48, and rear stabilizing surfaces 80 in cavity 26 bearing against rear stabilizing surfaces 62 on nose 48 (FIGS. 24-26 and 29). In the same way as noted above, stabilizing surfaces 36, 46, 62, 84 stably support wear member 10 on base 12.

The bearing contact between side surfaces 80 and inner surfaces 62, and between side surfaces 84 and inner surfaces 64, resists both vertical loads and loads with lateral components (called side loads). It is advantageous for the same surfaces to resist both vertical and side loads because loads are commonly applied to wear members in shifting directions as they are forced through the ground. With the laterally inclined stabilizing surfaces, bearing between the same surfaces can continue to occur even if a load shifts, for example, from more of a vertical load to more of a side load. With this arrangement, movement of the point on the nose is lessened, which leads to reduced wearing of the components.

A hollow portion 88, 90 is provided to each side of each of the upper and lower projections 74, 76 in cavity 26 for receiving side sections 56 of nose 48 (FIGS. 9, 10, 12, 13, 25, 26 and 29). The hollow portions 88, 90 complement and receive side sections 56. The upper hollow portions 88 are defined by side surfaces 80 on projection 74, and outer surfaces 92. The lower hollow portions 90 are defined by side surfaces 84 of projection 76, and outer surfaces 94. Outer surfaces 92, 94 are generally curved and/or angular in shape to complement the top, bottom and outside surfaces of the side sections 56.

Figure 18:
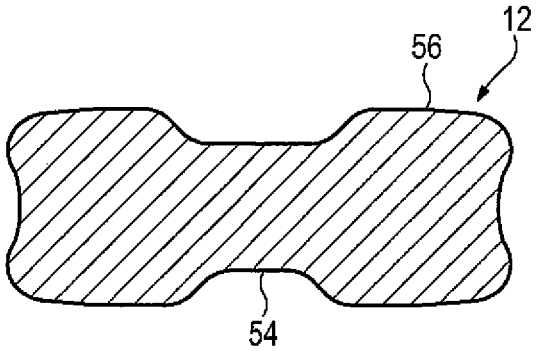
FIG. 18 is a cross-sectional view taken along line 18-18 in FIG. 15.
Figure 19:
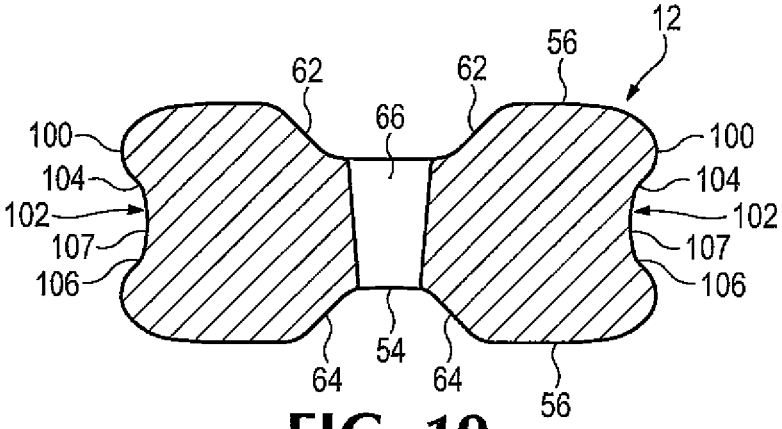
FIG. 19 is a cross-sectional view taken along line 19-19 in FIG. 15.

In the preferred construction, each sidewall 100 of nose 48 is provided with a channel 102 (FIGS. 18-20). Each channel is preferably defined by inclined channel walls 104, 106 giving the channel a generally V-shaped configuration. Channels 102 each preferably has a bottom wall 107 to avoid a sharp interior corner, but they could be formed without a bottom wall (i.e., with a blend joining walls 104, 106) if desired. Channel walls 104, 106 are each preferably inclined to resist both vertical and side loads. In a preferred construction, the channel walls 104, 106 diverge to define an included angle β of about 80-100 degrees (preferably about 45 degrees to each side of a central horizontal plane), though the angle could be outside of this range. Channel walls 104, 106 preferably each axially extend parallel to the longitudinal axis 42.

The opposite sides 98 of cavity 26 define projections 108 that complement and are received into channels 102. Projections 108 include bearing walls 110, 112 that oppose and bear against channel walls 104, 106 to resist vertical and side loading. Projections 108 preferably extend the length of sidewalls 98, but they could be shorter and received in only portions of channels 102. Bearing walls 110, 112 preferably match the lateral inclination of channel walls 104, 106, and axially extend substantially parallel to longitudinal axis 42.

While any opposing parts of the wear member 10 and base 12 may engage one another during use, the engagement of surfaces 34, 36, 44, 46, 62, 64, 80, 84, 104, 106, 110, 112 are intended to the primary bearing surfaces to resist both vertical and side loading. The contact of front wall 114 of cavity 26 against front face 116 of nose 48 are intended to be the primary bearing surfaces resisting axial loads (i.e., loads with components that are parallel to longitudinal axis 42).

Figure 26:
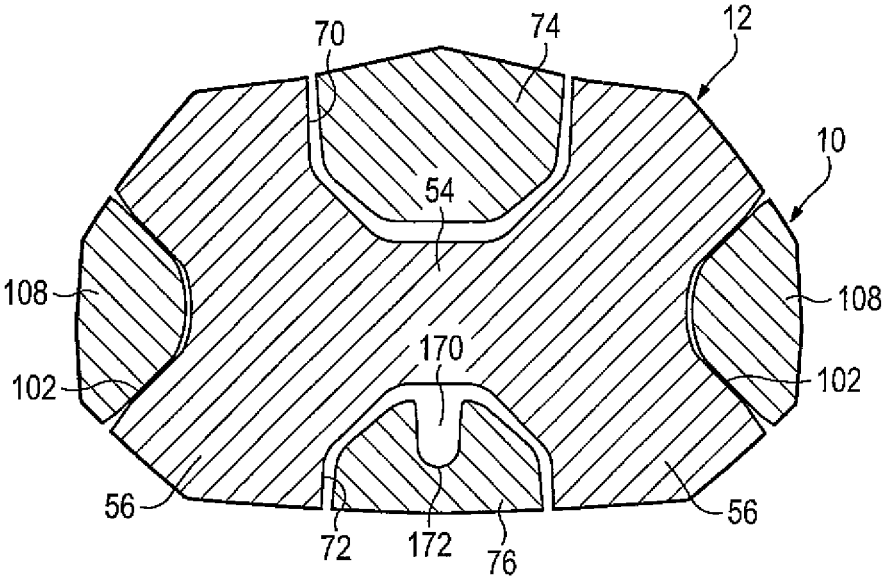
FIG. 26 is a cross-sectional view taken along line 26-26 in FIG. 21.
Figure 27:
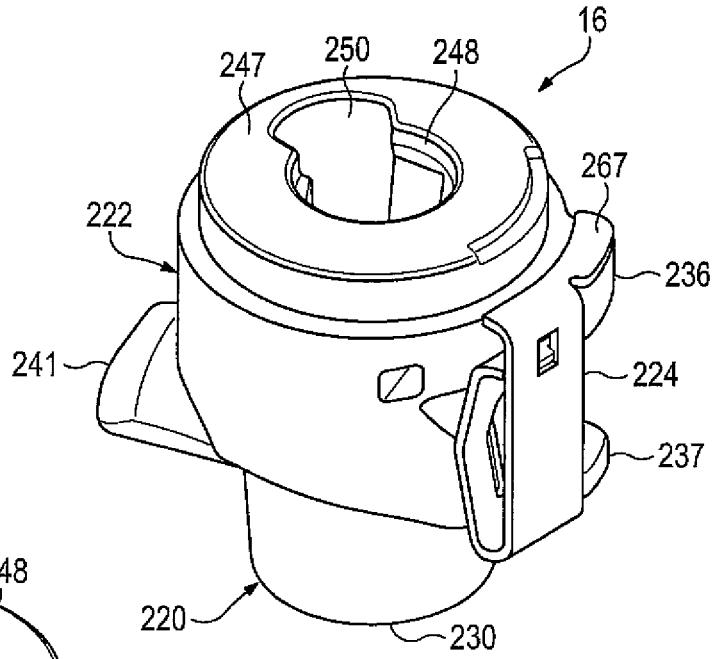
FIG. 27 is a perspective view of a lock of the wear assembly.
Figure 28:
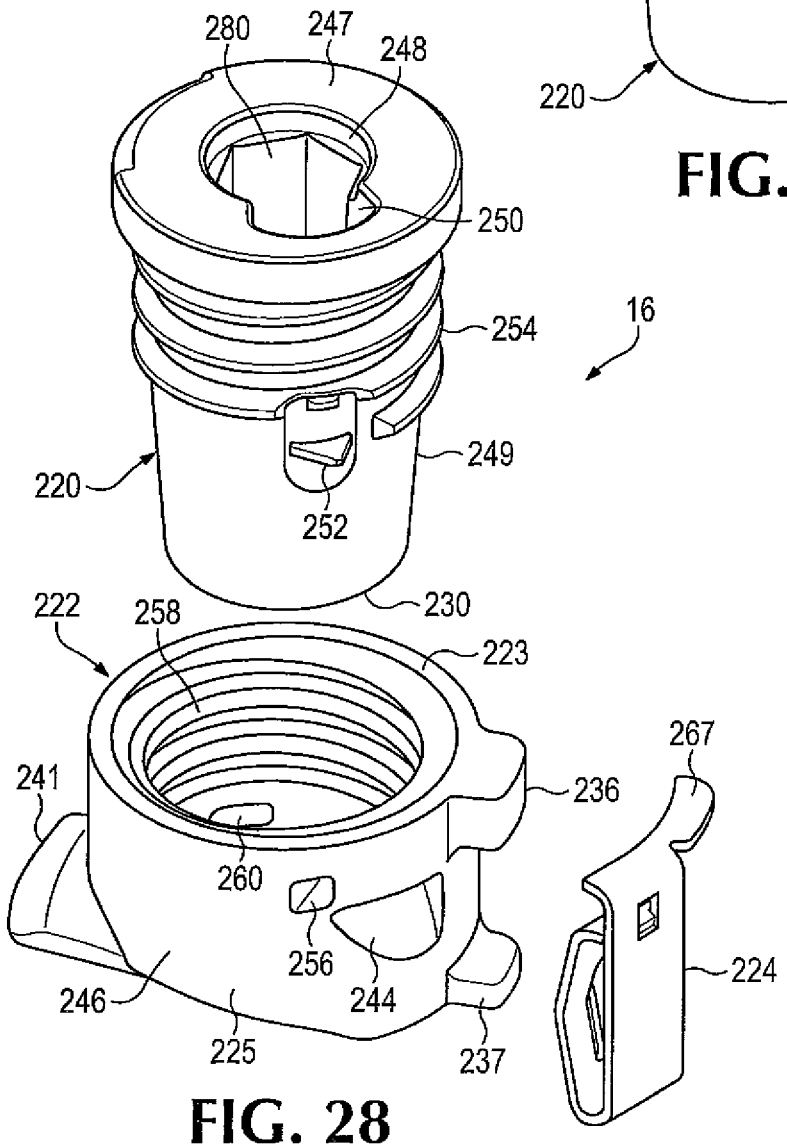
FIG. 28 is an exploded, perspective view of a lock of the wear assembly.

Wear member 10 preferably includes laterally spaced recesses 123, 125 in top wall 20 and corresponding laterally spaced recesses 127, 129 in bottom wall 22 at the rear end 28 (FIGS. 1, 2, 10, 14 and 26). Nose 48 preferably includes cooperative recesses 130, 132, 134, 136 (FIGS. 1-3, 5, 6 and 26) that are laterally offset from recesses 123, 125, 127, 129 on wear member 10 so that the rear end 28 of wear member 10 interlocks with the rear end 138 of nose 48 (FIGS. 1, 2 and 26). Side segments 124 of wear member 10 are received in side recesses 130, 136 of base 12, top segment 126 of wear member 10 is received in top recess 132 in base 12, and bottom segment 128 of wear member 10 is received in bottom recess 134 of base 12 when the wear member is fully seated on nose 48. Likewise, the lower and upper base segments 140, 142 are received in cooperative recesses 123, 125, 127, 129 of wear member 10. This interlocked engagement of wear member 10 and base 12 resists loads during use. Nevertheless, other constructions could be used or the interlocking construction could be omitted, i.e., with rear end 28 having a continuous construction without recesses 123, 125, 127, 129.

Wear member 10 preferably includes a wear indicator depression 170 that opens in cavity 26 (FIG. 26). In the illustrated example, wear indicator depression 170 is a slot formed in bottom wall 22 proximate rear end 28, though other positions can be used. Depression 170 has a bottom surface 172 to define a depth that is spaced from wear surface 13 when wear member 10 is new. When depression 172 breaks through wear surface 13 during use, it provides a visual indicator to the operator that it is time to replace wear member.

Locks 16 are preferably used to secure wear member 10 to base 12, and base 12 to nose 18 (FIGS. 1, 2 and 14). In the preferred construction, one lock 16 in top wall 20 is provided to hold wear member 10 to base 12, and one lock 16 in each side wall 151 of base 12 is provided to hold base 12 to adapter 19. Alternatively, two locks could be used to secure wear member 10 to base 12 and one lock to hold base 12 to adapter 19. A hole 146 is provided on each side 151 of base 12 for receiving the respective lock 16. Each hole 146, then, has the same construction as described above for hole 67. Further, a hole 161, like hole 66, is provided in the opposite sides 163 of nose 18. Holes 161 are preferably closed, but could be interconnected through nose 18. The locks though could have a wide variety of constructions. The lock securing base 12 to nose 18 could, for example, be constructed such as disclosed in U.S. Pat. No. 5,709,043.

Lock 16 includes a mounting component or collar 222 and a retaining component or pin 220 (FIGS. 27-44). Collar 222 fits in hole 67 of wear member 10 and includes a bore or opening 223 with threads 258 for receiving pin 220 with matching threads 254. A retainer 224, preferably in the form of a retaining clip, is inserted in hole 67 with collar 222 to prevent disengagement of the collar 222 from wear member 10. Preferably, retainer 224 is inserted during manufacture of wear member 10 so that lock 16 is integrally coupled with wear member 10 (i.e., to define a wear member that integrally includes a lock) for shipping, storage, installation and/or use of the wear member. Such a construction reduces inventory and storage needs, eliminates dropping the lock during installation (which can be particularly problematic at night), ensures the proper lock is always used, and eases the installation of the wear member. Nevertheless, if desired, retainer 224 could be removed at any time to effect removal of lock 16.

Figure 32:
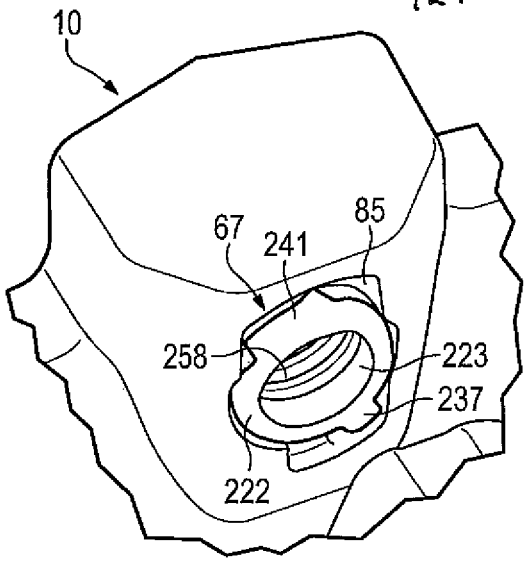
FIG. 32 is a partial perspective view of the wear member with a mounting component of the lock partially installed.
Figure 33:
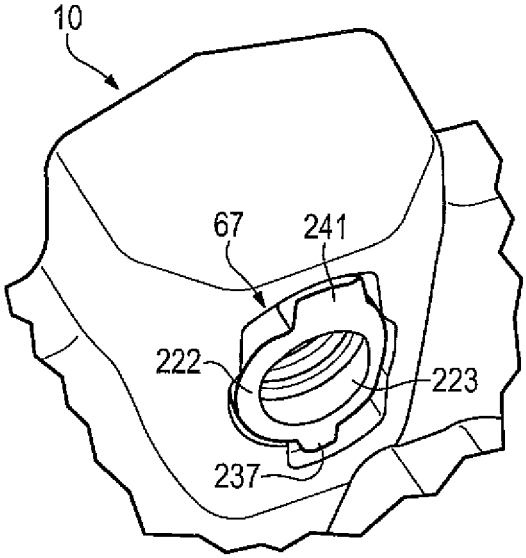
FIG. 33 is a partial perspective view of the wear member with the mounting component installed in the wear member.

Collar 222 has a cylindrical body 225 with lugs 236, 237 that project outward to contact and bear against bearing surfaces or shoulders 71, 73 of retaining structure 69 to hold lock 16 in place in wear member 10. To install collar 222, body 225 is inserted into hole 67 from within cavity 26 such that lugs 236, 237 is slid along passage or slot 75, and then rotated so that lugs 236, 237 straddle retaining structure 69 (FIGS. 32 and 33). Collar 222 is preferably translated into hole 67 until flange 241 is received in recess 85 and abuts against wall 93 of recess 85 (FIG. 32). Collar 222 is then rotated until lugs 236, 237 abut stops 87, 89 (FIG. 33). The rotation of collar 222 is preferably approximately 30 degrees so that lugs 236, 237 move into upper reliefs 77, 79 and abut stops 87, 89. Other stop arrangements are possible, e.g., the collar could have a formation abut end wall 81 or have only one lug engage the stop. In this position, lug 236 sets against upper bearing surface or shoulder 71, and lug 237 against lower bearing surface or shoulder 73. The engagement of lugs 236, 237 against both sides of retaining structure 69 hold collar 222 in hole 67 even under load during digging. Further, the cooperation of outer lug 236 and flange 241 provide a resistive couple against cantilever loads applied to pin 220 during use.

Figure 34:
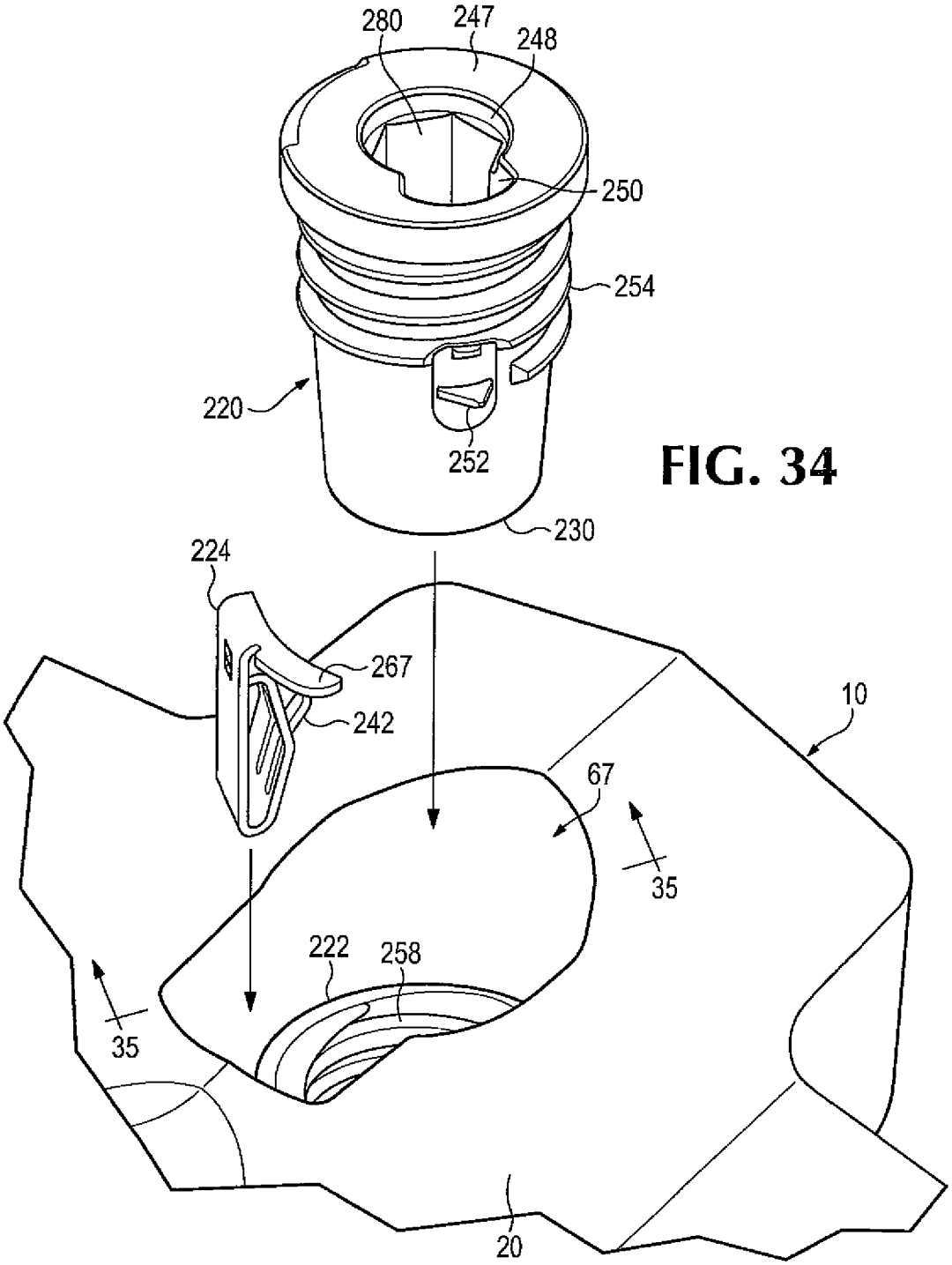
FIG. 34 is a partial perspective view of the wear member with an integral mounting component of the lock and a retainer and pin ready for installation.
Figure 35:
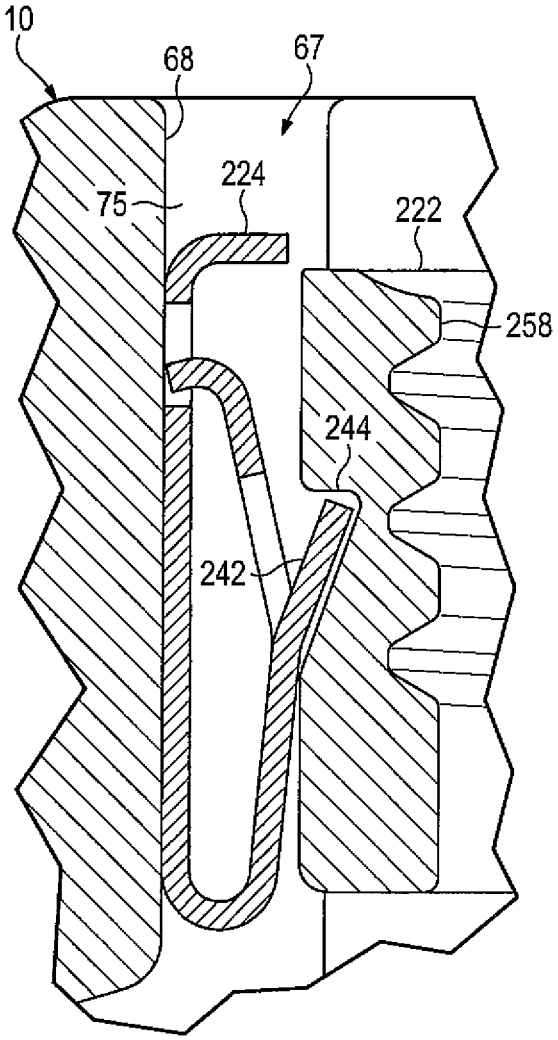
FIG. 35 is a cross-sectional view taken along line 35-35 in FIG. 34.
Figure 36:
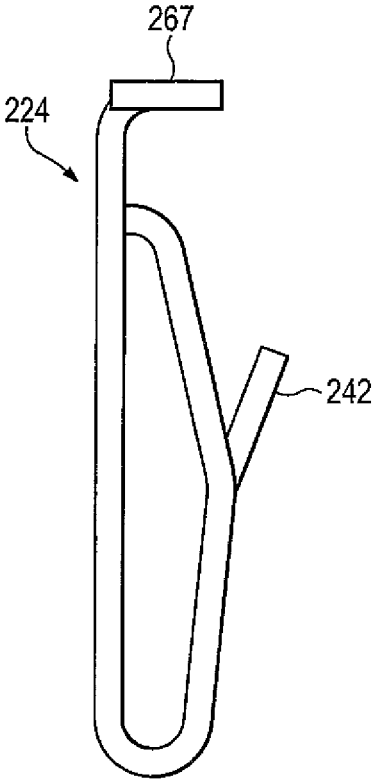
FIG. 36 is a side view of a retainer of the lock.
Figure 37:
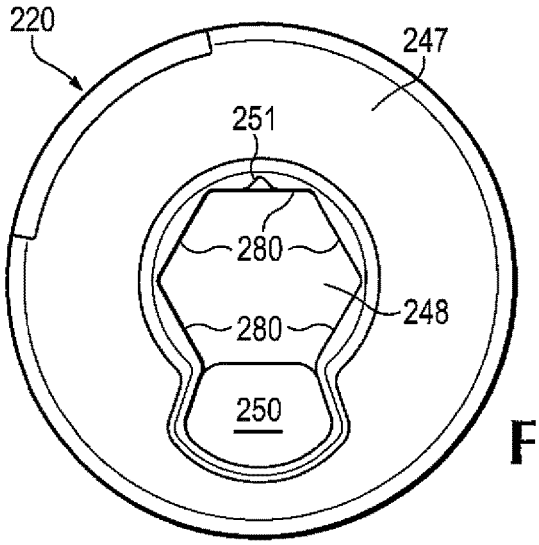
FIG. 37 is a top view of the pin.
Figure 38:
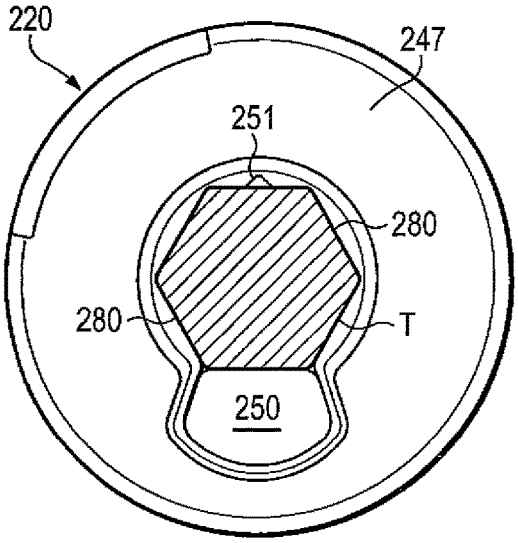
FIGS. 38 and 39 are each a top view of the pin with tools shown in the socket. [5Z]
Figure 39:
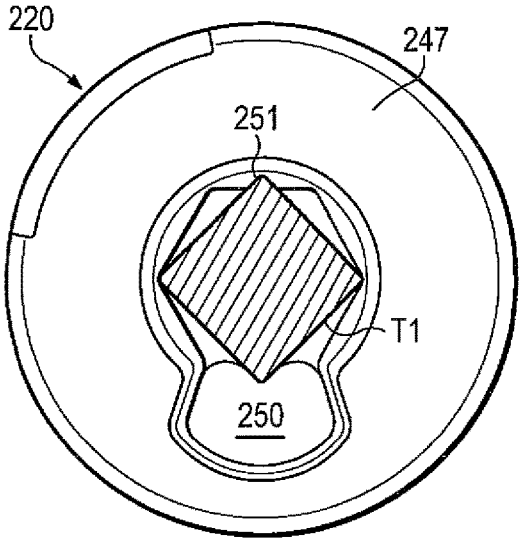
Figure 40:
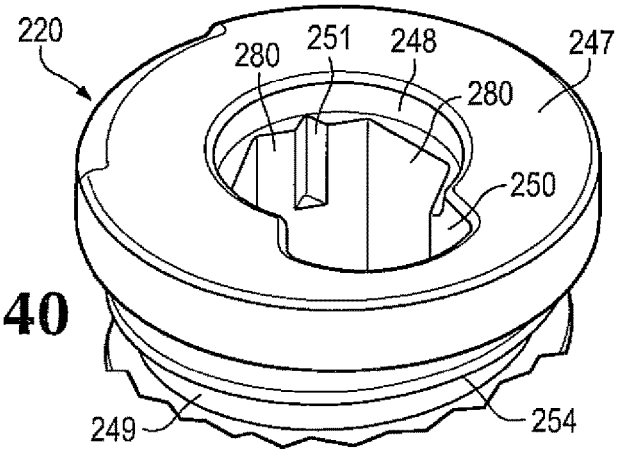
FIG. 40 is a partial perspective view of the pin.
Figure 41:
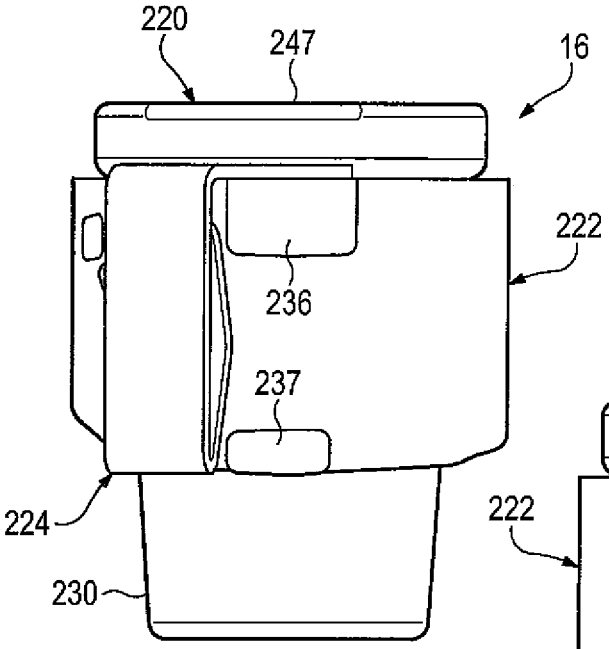
FIG. 41 is a front view of the lock.
Figure 42:
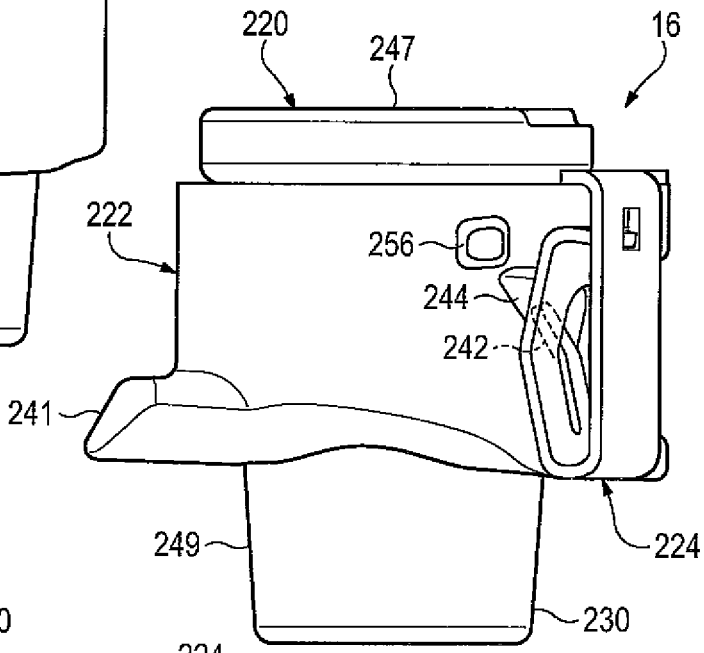
FIG. 42 is a side view of the lock.
Figure 43:
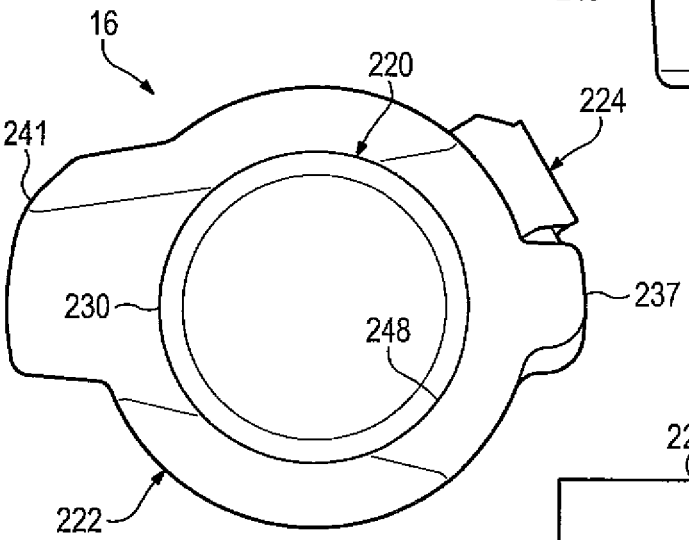
FIG. 43 is a bottom view of the lock.
Figure 44:
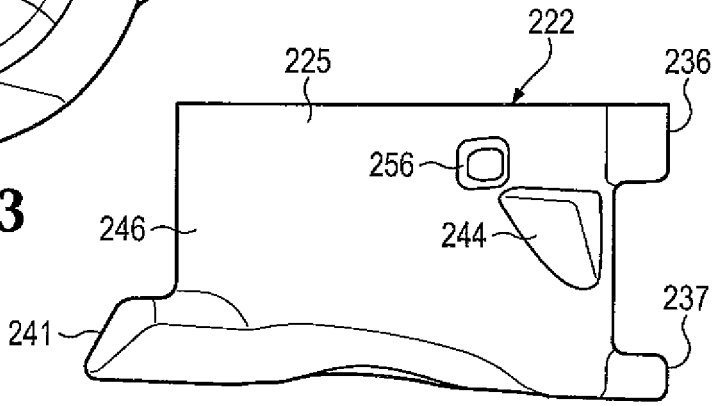
FIG. 44 is a side view of the mounting component of the lock.

Once collar 222 is in place, a retainer or clip 224 is inserted into passage 75 from outside wear member 10 (FIG. 34). Preferably, retainer 224 is snap-fit into slot 75, thereby preventing rotation of collar 222 so that lugs 236, 237 are retained in reliefs 77, 79 and against shoulders 71, 73. Retainer 224 is preferably formed of sheet steel with a bent tab 242 that snaps into a receiving notch 244 on an outer surface 246 of collar 222 to retain retainer 224 in wear member 10 (FIGS. 35 and 36). The retainer allows collar 222 to be locked in wear member 10 for secure storage, shipping, installation and/or use, and thereby define an integral part of wear member 10. Furthermore, retainer 224 preferably exerts a spring force against collar 222 to bias collar 222 to tighten the fit of collar 222 in hole 67. A flange 267 is preferably provided to abut lug 236 and prevent over-insertion of the retainer.

The engagement of lugs 236, 237 against shoulders 71, 73 mechanically hold collar 222 in hole 67 and effectively prevent inward and outward movement during shipping, storage, installation and/or use of wear member 10. A mechanical attachment is preferred because the hard, low alloy steel commonly used to manufacture wear members for earth working equipment generally lacks sufficient weldability. Collar 222 is preferably a single unit (one piece or assembled as a unit), and preferably a one piece construction for strength and simplicity. Retainer 224 is preferably formed of sheet steel as it does not resist the heavy loads applied during used. Retainer 224 is used only to prevent undesired rotation of collar 222 in hole 67 so as to prevent release of lock 16 from wear member 10.

Pin 220 includes a head 247 and a shank 249 (FIGS. 28-30, 34 and 37-40). Shank 249 is formed with threads 254 along a portion of its length from head 247. Pin end 230 is preferably unthreaded for receipt into hole 66 in nose 48. Pin 220 is installed into collar 222 from outside wear member so that pin end 230 is the leading end and pin threads 254 engage collar threads 258. A hex socket (or other tool-engaging formation) 248 is formed in head 247, at the trailing end, for receipt of a tool T to turn pin 220 in collar 222.

Preferably, hex socket 248 is provided with a clearance opening 250 in place of one facet (i.e., only five facets 280 are provided), to define a cleanout region (FIGS. 27, 28, 34 and 37-40). Cleanout region 250 makes the resulting opening larger, and therefore less likely to retain impacted fines and grit that often packs such pockets and openings on ground-engaging portions of earth working equipment. Cleanout region 250 also provides alternate locations to insert tools to break up and pry out compacted fines. For example, a sharp chisel, pick, or power tool implement may be shoved, pounded, or driven into cleanout region 250 to begin breaking up compacted fines. Should any damage occur to the interior surfaces of cleanout region 250 during the process, the damage generally has no impact on the five active tool faces of hex engagement hole 48. Once some of the compacted fines are broken out of cleanout region 250, any compacted fines inside hex engagement hole 248 may be attacked from the side or at an angle, as accessed through cleanout region 250.

An additional benefit of a lobe-shaped cleanout region is that the combination of a hex socket with a lobe-shaped cleanout region on one facet of the hex socket also creates a multiple-tool interface for pin 20. For example, a hex socket sized for use with a ⅞-inch hex drive T (FIG. 38), when elongated on one face, will allow a ¾-inch square drive T1 to fit (FIG. 39) as well. Optimal fit for such a square drive is obtained by forming a groove 251 in one facet of hex socket 248, opposite cleanout region 250. Other tools may fit as well, such as pry bars, if needed in the field when a hex tool is not available.

In one preferred embodiment, threaded pin 220 includes a biased latching tooth or detent 252, biased to protrude beyond the surrounding thread 254 (FIGS. 29, 30 and 34). A corresponding outer pocket or recess 256 is formed in the thread 258 of collar 222 to receive detent 252, so that threaded pin 220 latches into a specific position relative to collar 222 when latching detent 252 aligns and inserts with outer pocket 256. The engagement of latching detent 252 in outer pocket 256 holds threaded pin 220 in a release position relative to collar 22, which holds pin 220 outside of cavity 26 (or at least outside of hole 66 with sufficient clearance on nose 48), so that the wear member 10 can be installed on (and removed from) nose 48. The pin is preferably shipped and stored in the release position so that wear member 10 is ready to install. Preferably, latching detent 252 is located at the start of the thread on threaded pin 220, near the pin end 230. Outer pocket 256 is located approximately ½ rotation from the start of the thread on collar 222. As a result, pin 220 will latch into shipping position after approximately ½ turn of pin 220 within collar 222.

Further application of torque to pin 220 will squeeze latching detent 252 out of outer pocket 256. An inner pocket or recess 260 is formed at the inner end of the thread of collar 222. Preferably, the thread 258 of collar 222 ends slightly before inner pocket 260. This results in an increase of resistance to turning pin 220 as pin 220 is threaded into collar 222, when latching detent 252 is forced out of thread 258. This is followed by a sudden decrease of resistance to turning pin 220, as latching detent 252 aligns with and pops into the inner pocket. In use, there is a noticeable click or "thunk" as pin 220 reaches an end of travel within collar 222. The combination of the increase in resistance, the decrease in resistance, and the "thunk" provides haptic feedback to a user that helps a user determine that pin 220 is fully latched in the proper service position. This haptic feedback results in more reliable installations of wear parts using the present combined collar and pin assembly, because an operator is trained to easily identify the haptic feedback as verification that pin 220 is in the desired position to retain wear member 10 on base 12. The use of a detent 252 enables pin 220 to stop at the desired position with each installation unlike traditional threaded locking arrangements.

Preferably, latching detent 252 may be formed of sheet steel, held in place within a sump 262 within pin 220, resiliently fixed in place inside an elastomer 264. Sump 262 extends to open into cleanout region 250. The elastomer contained in sump 262 also may extend into cleanout region 250, when latching detent 252 is compressed during rotation of pin 220. Conversely, the elastomer contained in sump 262 forms a compressible floor for cleanout region 250, which may aid in the breakup and removal of compacted fines from cleanout region 250. Elastomer 264 may be molded around latching detent 252 so that elastomer 264 hardens in place and bonds to latching detent 252. The resulting subassembly of detent 252 and elastomer 264 may be pressed into place through cleanout region 250, and into sump 262. A preferred construction of latching detent 252 includes a body 266, a protrusion 268, and guide rails 270. Protrusion 268 bears against a wall of sump 262, which keeps latching detent 252 in proper location relative to thread 254. Guide rails 270 further support latching detent 252, while allowing compression of latching detent 252 into sump 262, as discussed above.

When pin 220 is installed into collar 222, it is rotated ½ turn to the release position for shipping, storage and/or installation of wear member 10. The wear member containing integrated lock 16 is installed onto nose 48 of base 12 (FIG. 29). Pin 220 is then preferably rotated 2½ turns until pin end 230 is fully received into hole 66 in the locked or service position (FIG. 30). More or fewer rotations of threaded pin 220 may be needed, depending on the pitch of the threads, and on whether more than one start is provided for the threads. The use of a particularly coarse thread requiring only three full rotations of threaded pin 220 for full locking of a wear member 10 to base 12 has been found to be easy to use in field conditions, and reliable for use under the extreme conditions of excavation. Furthermore, the use of a coarse helical thread is better in installations where the lock assembly will become surrounded by compacted fines during use.

Lock 16 is located within the upper recess 70 between side sections 56 for protection against contact with the ground and wear during use (FIGS. 25 and 30). The positioning of lock 16 deep in wear assembly 14 helps shield the lock from wear caused by the ground passing over wear member 10. Preferably, lock 16 is recessed with hole 67 so that it remains shielded from moving earthen material over the life of the wear member. In a preferred example, pin 220 in the locked position is in the bottom 70% or lower in hole 67. Earthen material will tend to accumulate in hole 67 above lock 10 and protect the lock from undue wear even as wear member 10 wears. Further, the lock is generally centrally located in wear assembly with pin end 230 located at or proximate the center of hole 66 in the locked position. Positioning the lock closer to the center of nose 18 will tend to reduce ejection loads applied to the lock during use of the wear member, and especially with vertical loads that tend to rock the wear member on the base.

Pin 20 may be released using a ratchet tool or other tool to unscrew pin 220 from collar 222. While pin 220 can be removed from collar 222, it need only be backed up to the release position. Wear member 10 can then be removed from nose 48. The torque of unscrewing pin 220 may exert substantial torsion loads on collar 222, which loads are resisted by stops 77 and 79, providing a strong and reliable stop for lugs 236 and 237. [93] The mounting component 222 of lock 16 defines a threaded bore 223 for receiving a threaded securing pin 220 that is used to releasably hold wear member 10 to base 12 (and base 12 to adapter 19). The separate mounting component 222 can be easily machined or otherwise formed with threads, and secured within the wear member for less expense and higher quality threads as compared to forming the threads directly in the wear member. The steel used for wear member 10 are very hard and it is difficult to cast or otherwise form screw threads into hole 67 for the intended locking operation. The relatively large size of wear member 10 also makes it more difficult to cast or otherwise form screw threads in hole 67. The mounting component 222 can be mechanically held within the hole in the wear member to resist axial movement in either direction (i.e., that is in and out of hole 67) during use so as to better resist unintended loss of the lock during shipping, storage, installation and use. On account of the hard steel typically used for wear member 10, mounting component 222 could not be easily welded into hole 67. [94] The use of a lock in accordance with the present invention provides many benefits: (i) a lock integrated into a wear member so that the lock ships and stores in a ready to install position for less inventory and easier installation; (ii) a lock that requires only common drive tools such as a hex tool or ratchet driver for operation, and requires no hammer; (iii) a lock with easy tool access; (iv) a lock with clear visual and haptic confirmation of correct installation; (v) a new lock provided with each wear part; (vi) a lock that is positioned for easy access; (vii) a lock with a simple intuitive universally understood operation; (vii) a permanent mechanical connection between components of differing geometric complexity creates a finished product with features and benefits extracted from specific manufacturing processes; (viii) a lock integration system built around simple castable feature where the integration supports high loads, requires no special tools or adhesives and creates a permanent assembly; (ix) a lock with a hex engagement hole elongated on one facet allowing easier cleanout of soil fines with simple tools; (x) a lock located with a central part of the wear assembly to protect the lock from wear and reduce the risk of lock ejection; (xi) a lock with reaction lugs on the lock collar to carry system loads perpendicular to bearing faces; (xii) a retaining clip installed at the manufacturing source that holds the collar into the wear member while also biasing the collar against the load bearing interface and taking slack out of the system; (xiii) a design approach that simplifies casting complexity while supporting expanded product functionality; (xiv) a design approach whereby critical fit surfaces in the lock area need only be ground to fit one part which could act as a gage; and (xv) a design that fits within standard plant processes.

Lock 16 is a coupling arrangement for securing two separable components in an excavating operation. The system consists of a pin 220 received in a hole 66 in a base 12 and a collar 222 mechanically retained in the wear member 10. The collar contains features supportive of integrated shipment, load transmission, lock installation and lock removal. The collar is secured to the wear member with a retainer 224 which acts upon two lugs 236, 237 at the perimeter of the collar maintaining the lugs in an optimal load bearing orientation. The retainer also tightens the fit between components. The pin 220 helically advances through the center of the collar 222 between two low energy positions created by an elastomer backed latching mechanism. The first position keeps ½ turn of thread engaged between the collar and the pin for retention during shipment. The pin 220 advances into the second low energy position after rotating 2½ turns ending in a hard stop signaling that the system is locked. When the wear member 10 requires changing, the pin 220 is rotated counter-clockwise and removed from the assembly allowing the wear member to slide free from the base.

While the illustrated embodiment is an excavating tooth, the features associated with the locking of wear member 10 on base 12 can be used in a wide variety of wear assemblies for earth working equipment. For example, runners can be formed with a hole, like hole 67, and mechanically secured to a base defined on the side of a large bucket, a chute surface, a bed of a truck body and the like.

The disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

The invention claimed is:

1. A wear member comprising (i) a wearable body having a hole having a central axis, and (ii) a lock including a collar having a threaded opening received in the hole, and a threaded pin received in the threaded opening for adjustment between a hold position where the threaded pin extends through the collar to contact a base to secure the wear member to the base and a release position where the threaded pin permits release of the wear member from the base, wherein the hole includes slots and the collar includes lugs received into the slots to prevent the movement of the collar along the central axis.

2. A wear member in accordance with claim 1 including a latching detent to secure the threaded pin in each of the hold and release positions.

3. A wear member in accordance with claim 2 wherein the latching detent includes a biased tooth projecting outward on the pin and two spaced apart recesses within the threaded opening to receive the tooth in the hold and release positions respectively.

4. A wear member in accordance with claim 1 including a retainer received into the hole to prevent rotation of the collar about the central axis.

5. A wear member in accordance with claim 1 wherein the wearable body includes a rearwardly-facing mounting cavity for receiving a base to facilitate attachment to a digging edge of an earth working equipment.

6. A wear member in accordance with claim 1 wherein the collar includes a body that defines the threaded opening, and the lugs and body are a one-piece member.

7. A wear member comprising (i) a wearable body having a hole having a central axis, and (ii) a lock including one-piece a collar having a threaded opening received in the hole, and a threaded pin received in the threaded opening for adjustment between a hold position where the threaded pin secures the wear member to a base and a release position where the threaded pin permits release of the wear member from the base, and a retainer received into the hole to prevent rotation of the collar about the central axis.

8. A wear member in accordance with claim 7 wherein the retainer is a clip with an extending tab to prevent removal from the hole.

9. A wear member in accordance with claim 7 wherein the retainer is formed of sheet steel.

10. A wear member in accordance with claim 7 including a latching detent to secure the threaded pin in each of the hold and release positions.

11. A wear member in accordance with claim 10 wherein the latching detent includes a biased tooth projecting outward on the pin and two spaced apart recesses within the threaded opening to receive the tooth in the hold and release positions respectively.

12. A wear member in accordance with claim 7 wherein the wearable body includes a rearwardly-facing mounting cavity for receiving a base to facilitate attachment to a digging edge of an earth working equipment.

13. A wear member comprising (i) a wearable body having a hole having a central axis, and (ii) a lock including a collar having a threaded opening received in the hole, and a threaded pin received in the threaded opening for adjustment between a hold position where the threaded pin secures the wear member to a base and a release position where the threaded pin permits release of the wear member from the base, and a latching detent to secure the threaded pin in each of the hold and release positions.

14. A wear member in accordance with claim 13 wherein the latching detent includes a biased tooth projecting outward on the pin and the two spaced apart recesses are within the threaded opening to receive the tooth in the hold and release positions respectively.

15. A wear member in accordance with claim 13 including a retainer that is received into the hole to prevent rotation of the collar about the central axis.

16. A wear member in accordance with claim 15 wherein the retainer is a clip with an extending tab to prevent removal from the hole.

17. A wear member in accordance with claim 15 wherein the retainer is formed of sheet steel.

18. A wear member in accordance with claim 13 wherein the wearable body includes a rearwardly-facing mounting cavity for receiving a base to facilitate attachment to a digging edge of an earth working equipment.

19. A wear member in accordance with claim 13 wherein the collar or pin includes a pair of spaced apart recess, and the other of the collar or pin includes a biased latch member receivable into one of the recesses in the hold position and in the other of the recesses in the release position.

* * * * *